US006854838B2

(12) United States Patent
Taku

(10) Patent No.: US 6,854,838 B2
(45) Date of Patent: Feb. 15, 2005

(54) INK JET PRINTER

(75) Inventor: Masakazu Taku, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/463,577

(22) Filed: Jun. 18, 2003

(65) Prior Publication Data

US 2003/0234842 A1 Dec. 25, 2003

(30) Foreign Application Priority Data

Jun. 21, 2002 (JP) ..... 2002-182163
Jun. 21, 2002 (JP) ..... 2002-182164

(51) Int. Cl.[7] ..... B41J 2/175
(52) U.S. Cl. ..... 347/85
(58) Field of Search ..... 347/85, 86, 87

(56) References Cited

U.S. PATENT DOCUMENTS

| | | | | |
|---|---|---|---|---|
| 6,003,981 | A | * 12/1999 | Cameron et al. | 347/85 |
| 2001/0040610 | A1 | 11/2001 | Kurata et al. | 347/85 |
| 2002/0063759 | A1 | 5/2002 | Hirano et al. | 347/85 |

FOREIGN PATENT DOCUMENTS

| | | |
|---|---|---|
| EP | 536980 | 4/1993 |
| EP | 1186425 | 3/2002 |
| JP | 5-238016 | 9/1993 |
| JP | 9-29991 | 2/1997 |
| JP | 11-348315 | 12/1999 |
| JP | 2000-86819 | 3/2000 |
| JP | 2000-334982 | 12/2000 |
| JP | 2002-89434 | 3/2002 |

* cited by examiner

*Primary Examiner*—Thinh Nguyen
(74) *Attorney, Agent, or Firm*—Fitzpatrick, Cella, Harper & Scinto

(57) ABSTRACT

A printing head includes a reserving portion that reserves a predetermined amount of ink. A supply system of an ink jet printer is configured so that an ink housing portion constituting an ink supply source intermittently supplies ink to the reserving portion using appropriate timings. The housing portion housing ink to be supplied to the head is located, acrossing an area where a printing is performed onto a sheet by the head, in a space opposite to a space in which the head is scanned. The housing portion is moved to or from the scanning space of the head so as to be joined to the head as required for an ink supply. That is, ink is intermittently supplied properly by moving the ink supply side to the joint position without moving the head. This provides an ink jet printer that does not affect the mounting accuracy of the head.

4 Claims, 25 Drawing Sheets

INK JET PRINTER

This application claims priority from Japanese Patent Application Nos. 2002-182163 filed Jun. 21, 2002 and 2002-182164 filed Jun. 21, 2002, which are incorporated hereinto by reference.

BACKGROUND OF THE INVENTION

1. Field of the Invention

The present invention relates to an ink jet printer, and in particular, to improvements in an ink supply system that supplies ink to a printing head.

2. Description of the Related Art

Inkjet printing apparatuses which form an image on a printing medium by depositing ink to the printing medium using an inkjet printing head include that which form an image by ejecting ink while moving a printing head relative to a printing medium and that which form an image by ejecting ink while moving a printing medium relative to a fixed printing head conversely.

There are two general types of methods of supplying ink to a printing head used in such an inkjet printing apparatus. One is a type in which a supply system is configured such that an amount of ink is always or continuously supplied to a printing head according to the amount of ink ejected (hereinafter referred to as a continuous supply type), and the other is a type in which a printing head is provided with a reservoir (sub-tank or second ink tank) for reserving a predetermined amount of ink and in which a supply system is configured such that ink is supplied to the reservoir from an ink supply source (main tank or first ink tank) at appropriate timing or intermittently (hereinafter referred to as an intermittent supply type).

The continuous supply type is further categorized into two types, for example, when it is used in an inkjet printing apparatus of a type referred to as a serial type in which a printing head is scanned back and forth in predetermined directions relative to a printing medium and in which the printing medium is transported in a direction substantially orthogonal thereto to form an image. One is a type referred to as an on-carriage type in which ink is supplied by integrally or detachably attaching an ink tank to a printing head that is carried and moved back and forth (main scanning) by a carriage. The other is a tube supply type in which an ink tank that is separate from a printing head carried on a carriage is fixedly installed in a part of a printing apparatus other than the printing head and in which the ink tank is connected to the printing head through a flexible tube to supply ink. In some of the latter type, a second ink tank that serves as an intermediate tank between an ink tank and a printing head is mounted on the printing head or the carriage.

When an on-carriage type structure is adopted, there are limits on the project area in a direction perpendicular to the main scanning direction and volume of members that move with a carriage (a printing head and an ink tank undetachably or detachably integrated with the same). Therefore, only an ink tank having a very limited capacity can be used when a small-sized printing apparatus, especially, a portable printing apparatus is to be formed. This results in very frequent replacement of the printing head integral with the ink tank or the ink tank alone, which has been problematic from the viewpoint of operability and running cost.

When a tube supply type structure is adopted, although members that move with a carriage during main scanning can be made compact to some degree, it is difficult to make the apparatus as a whole compact because a space is required for a tube member to move to follow up the carriage, the tube member coupling a printing head on the carriage and an ink tank located outside the carriage to supply ink. Further, the recent trend is that a carriage is scanned at a high speed to accommodate increases in the speed of printing operations, and resultant severe rocking of a tube that follows the carriage results in changes in the pressure of ink in an ink supply system for the printing head. It is therefore required to provide various complicated pressure buffering mechanisms in order to suppress pressure changes, it has been difficult to achieve a size reduction in this respect too.

On the contrary, in the case of the intermittent supply method that is used for serial type inkjet printing apparatus for example, a relatively small second ink tank and printing head are provided on a carriage; a relatively large first ink tank is provided in a part other than the carriage of the printing apparatus; and a supply system is configured such that ink is supplied from the first ink tank to the second ink tank at appropriate timing. A structure is also employed in which the ink supply system between the first and second ink tanks is spatially separated or the ink channel is blocked with a valve during main scanning to achieve fluid isolation between the first and second ink tanks (For example Japanese Patent Application Laid-open Nos. 5-238016 (1993) and 2000-86819). Basically, this makes it possible to solve various problems attributable to the size of moving members as described above such as an ink tank and the rocking of a tube that have limited efforts to achieve a small size in the case of the continuous supply type.

With such an intermittent supply method, a configuration is employed in which the printing head is moved to an area outside a scanning range for printing so that a first and second ink tanks are fluid-coupled together in this area. Thus, a joint portion for this fluid communication must be arranged outside the scanning range for printing. This restricts a reduction in the size of the ink jet printer.

In contrast, Japanese Patent Application Laid-open No. 2000-334982 discloses a configuration in which a joint portion that fluid-couples a first and a second ink tanks together is arranged above the scanning range of a printing head. In this configuration, the printing head is rotated to this joint position for fluid communication. This configuration utilizes spaces more effectively than the configuration in which the joint portion is arranged in the area outside the scanning range for printing. This facilitates a reduction in the size of the ink jet printer.

With the ink jet printing method, ink is ejected from ejection openings to a printing medium. In recent years, an increase in printing resolution or quality has been strongly desired. Accordingly, the size of each ejection opening has been increasingly reduced and a correspondingly reduced amount of ink has been ejected from the ejection openings. Thus, it has been desirable to deposit very accurately ink to a printing medium at specific positions. To achieve this, the clearance between the ejection openings and the printing medium must be rigidly managed.

However, all the conventional ink jet printers based on the intermittent supply method are based on the movement of the printing head to the joint position, where the fluid communication takes place. Further, a relatively strong force is required to connect and remove the ink tanks to and from the joint portion. Consequently, in the configuration in which the printing head is moved for such connection or removal, the mounting accuracy of the printing head may decrease, the position of which must be rigidly managed with respective to the printing medium.

SUMMARY OF THE INVENTION

The present invention is provided to solve these problems. It is an object of the present invention to allow ink to be intermittently supplied appropriately without affecting the mounting accuracy of a printing head, while employing the intermittent supply method and effectively utilizing spaces to reduce the size of an ink jet printer.

In an aspect of the present invention, there is provided an ink let printer for performing printing on a printing medium by using a printing head for ejecting ink, comprising:

holding means for holding a housing portion that houses ink to be supplied to the printing head, the holding means being located, acrossing an area where a printing is performed onto the printing medium by the printing head, in a space opposite to a space in which the printing head performs a scanning onto the printing means; and moving means for moving the housing portion to and from a scanning space in which the printing head is subjected to the scanning, and once the housing portion has moved to the scanning space, joining the printing head and the housing portion together to allow ink to be supplied.

The above and other objects, effects, features and advantages of the present invention will become more apparent from the following description of embodiments thereof taken in conjunction with the accompanying drawings.

BRIEF DESCRIPTION OF THE DRAWINGS

FIG. 12 is a sectional view taken along the carrier scanning direction and showing the print mechanism to illustrate the installation of the ink cartridge and the like;

DETAILED DESCRIPTION OF PREFERRED EMBODIMENTS

The present invention will be described below in detail with reference to the drawings.

Incidentally, in the present specification, the wording "printing" or "recording" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" (also referred to as "liquid" in some occasions) should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

Meantime, the present invention may be applied to a printing head in which a thermal energy generated by an electrothermal transducer is utilized to cause a film boiling to liquid in order to form bubbles, a printing head in which an electromechanical transducer is employed to eject liquid, a printing head in which a static electricity or air current is utilized to form and eject a liquid droplet and the others which are proposed in the art of an inkjet printing technology. Specifically, the printing head in which the electrothermal transducer is utilized is advantageously employed to achieve a compact structure.

(1.1) First Embodiment

Figure 1:
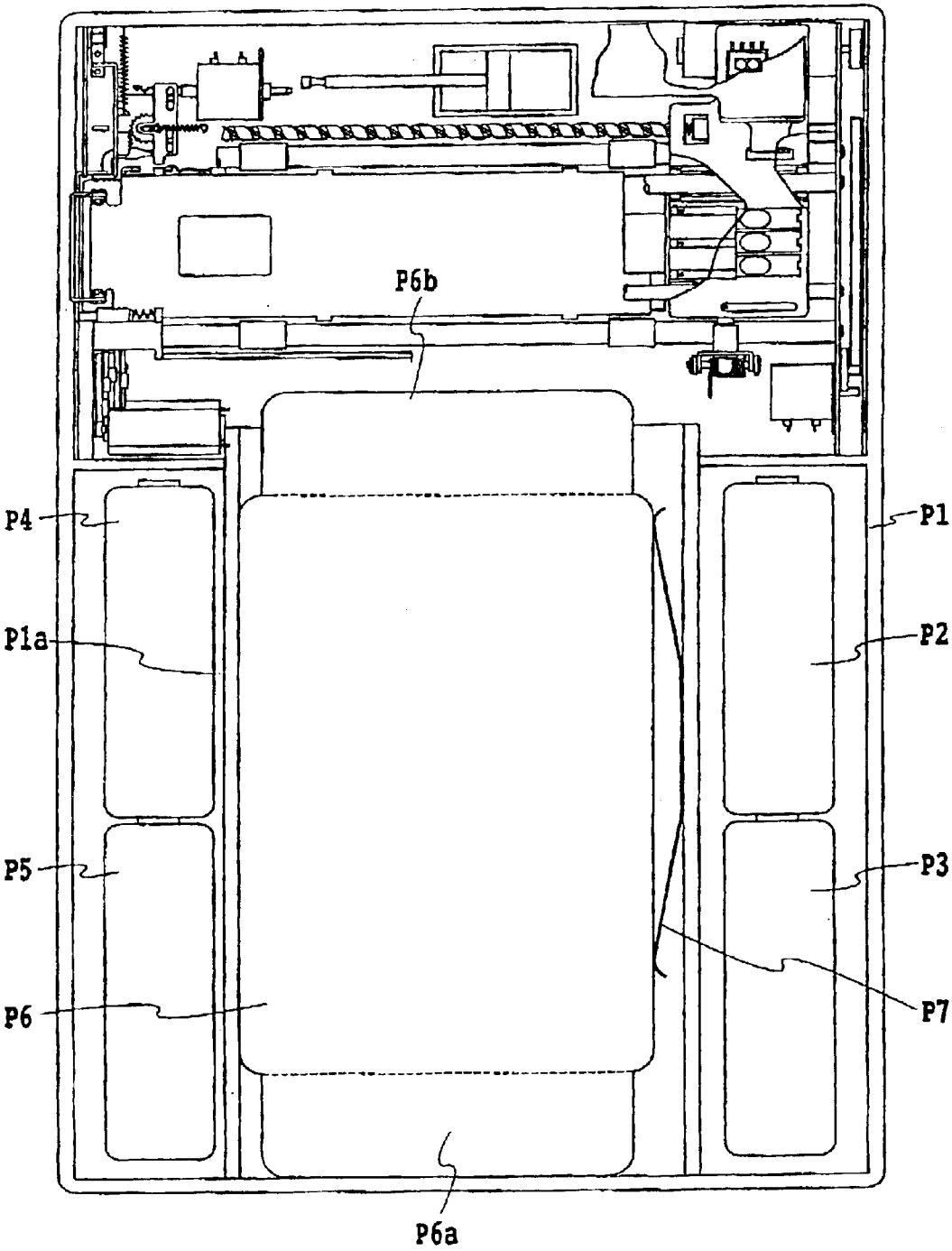
FIG. 1 is a plan view showing an entire configuration of a printer according to a first embodiment of the present invention.
Figure 2:
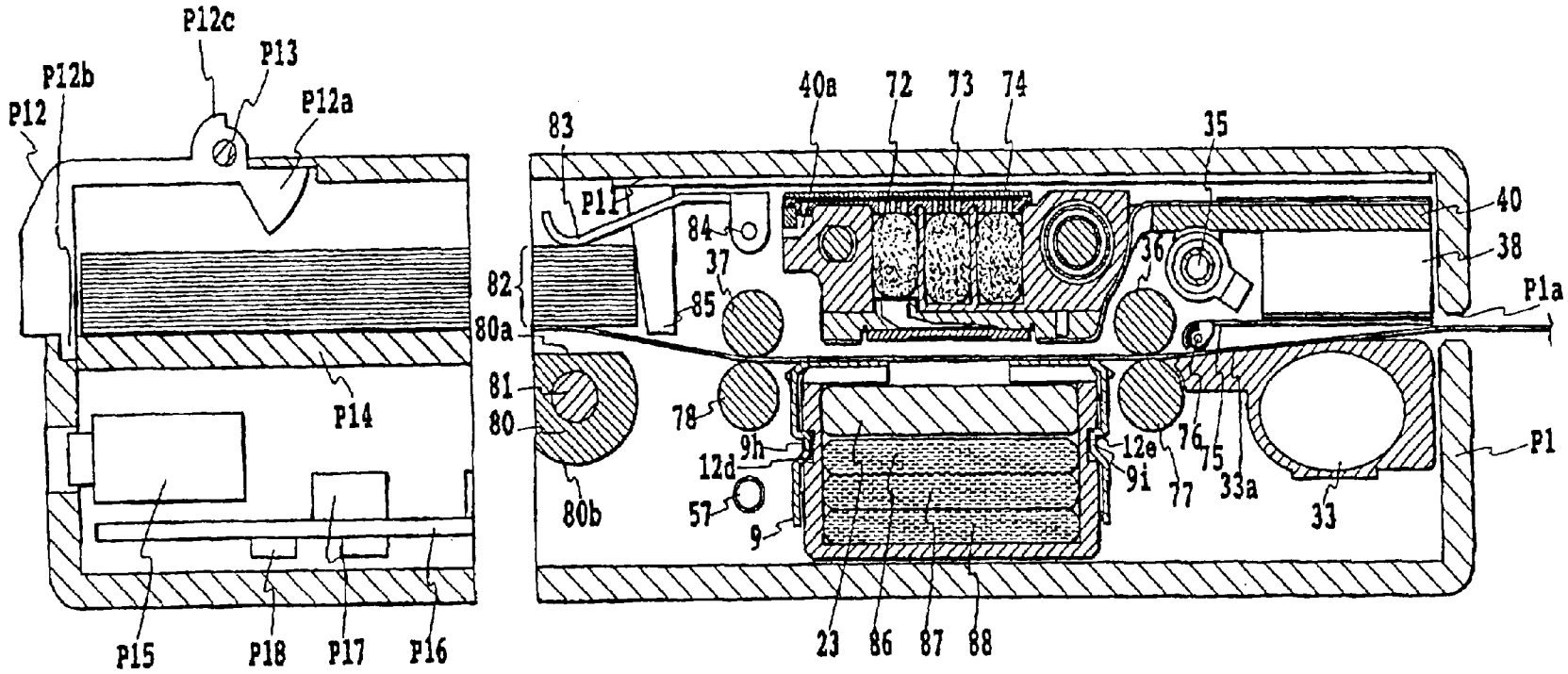
FIG. 2 is a side sectional view taken along the direction in which a printing medium is conveyed, the view showing a print mechanism of the printer according to the first embodiment.

FIG. 1 is a plan view showing the entire configuration of the printer with an upper cover of an outer case removed. FIG. 2 is a side sectional view taken along a sub-scanning direction (a direction in which printing media are conveyed).

In FIG. 2, reference numeral P1 denotes a printer main body constituting an outer case. Reference numerals P2 to P5 denote batteries used as a power source for the printer and laid out in series. Reference numeral P6 denotes a print sheet having tabs P6*a* and P6*b* formed at a leading and trailing ends, respectively, so as to serve as margins. These tabs can be cut off at perforations shown by broken lines after a printing operation has been completed to provide a photograph without any margins. Reference numeral P7 denotes a spring that biases and urges the print sheet P6 against a print reference surface P1*a*. The spring serves to prevent the print sheet P6 from being misaligned or fed obliquely.

In FIG. 2, reference numeral P14 denotes a pedestal on which sheets 82 as the print sheets P6 are stacked. The pedestal P14 is fixed to the printer main body P1. Further, reference numeral P15 denotes a connector conforming to a USB standard or the like and which is used to connect the printer to external equipment. The connector is attached to a main print plate P16. Reference numerals P17 and P18 illustratively denote electric parts mounted on the main print plate P16. A main IC (not shown) is also mounted on this main print plate to control operations of the printer.

(Opening and Closing Lid for Installing Ink Cartridge)

Figure 3:
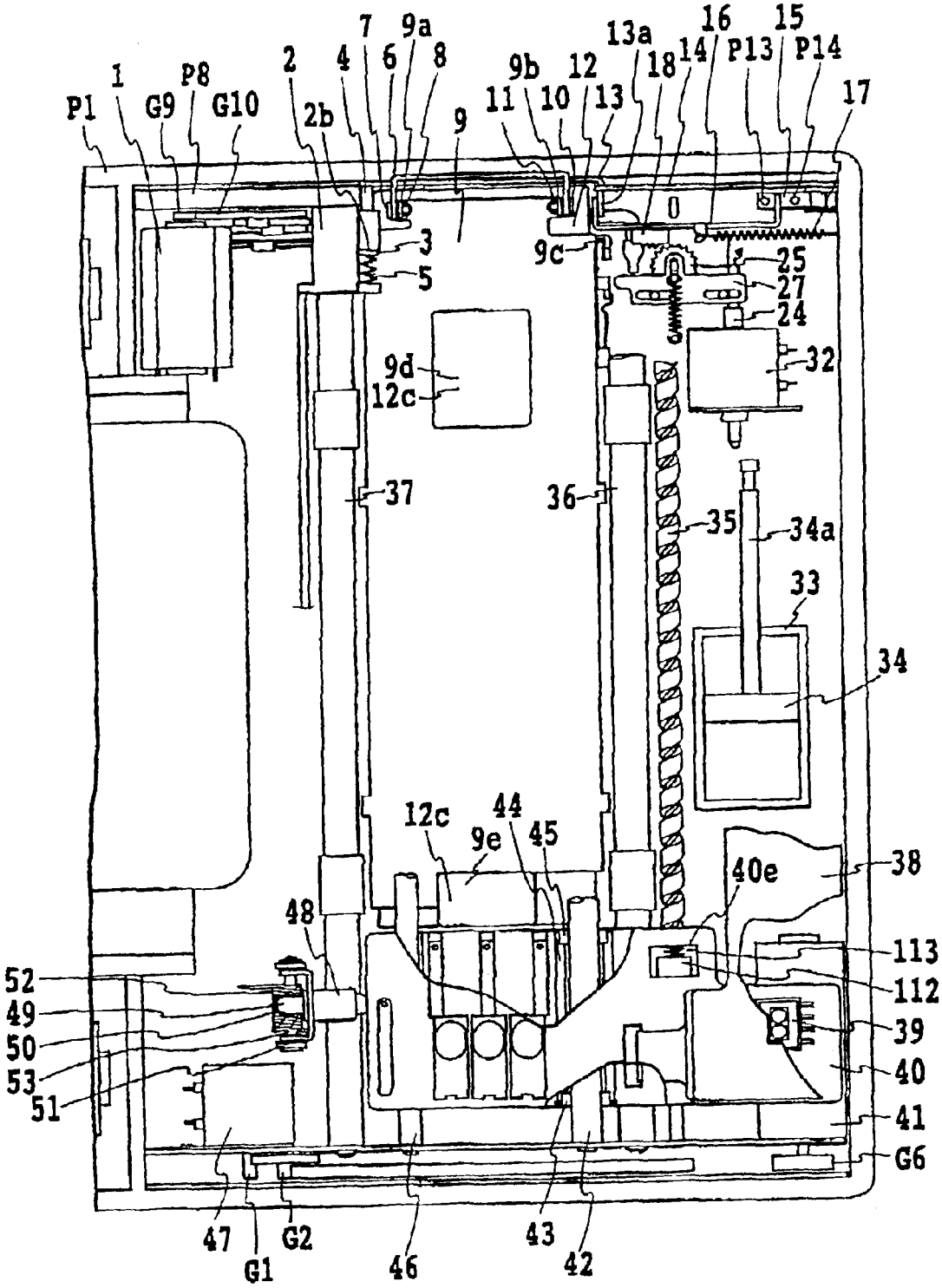
FIG. 3 is an enlarged plan view of the print mechanism in the printer in FIG. 3.
Figure 4:
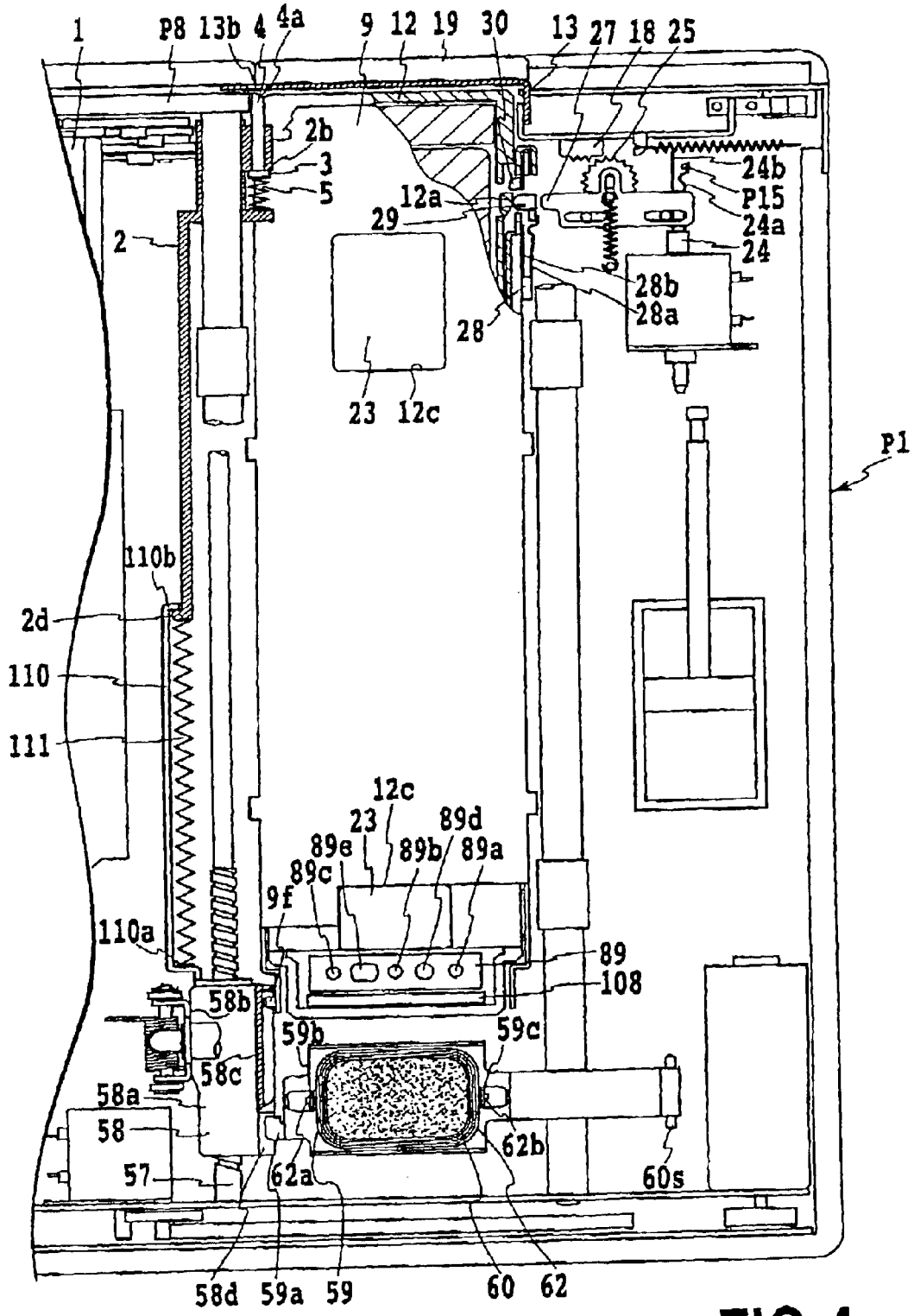
FIG. 4 is a plan view illustrating a mounting portion of the ink cartridge in the printer according to the first embodiment with some of the constituent members in FIG. 3 removed.
Figure 5:
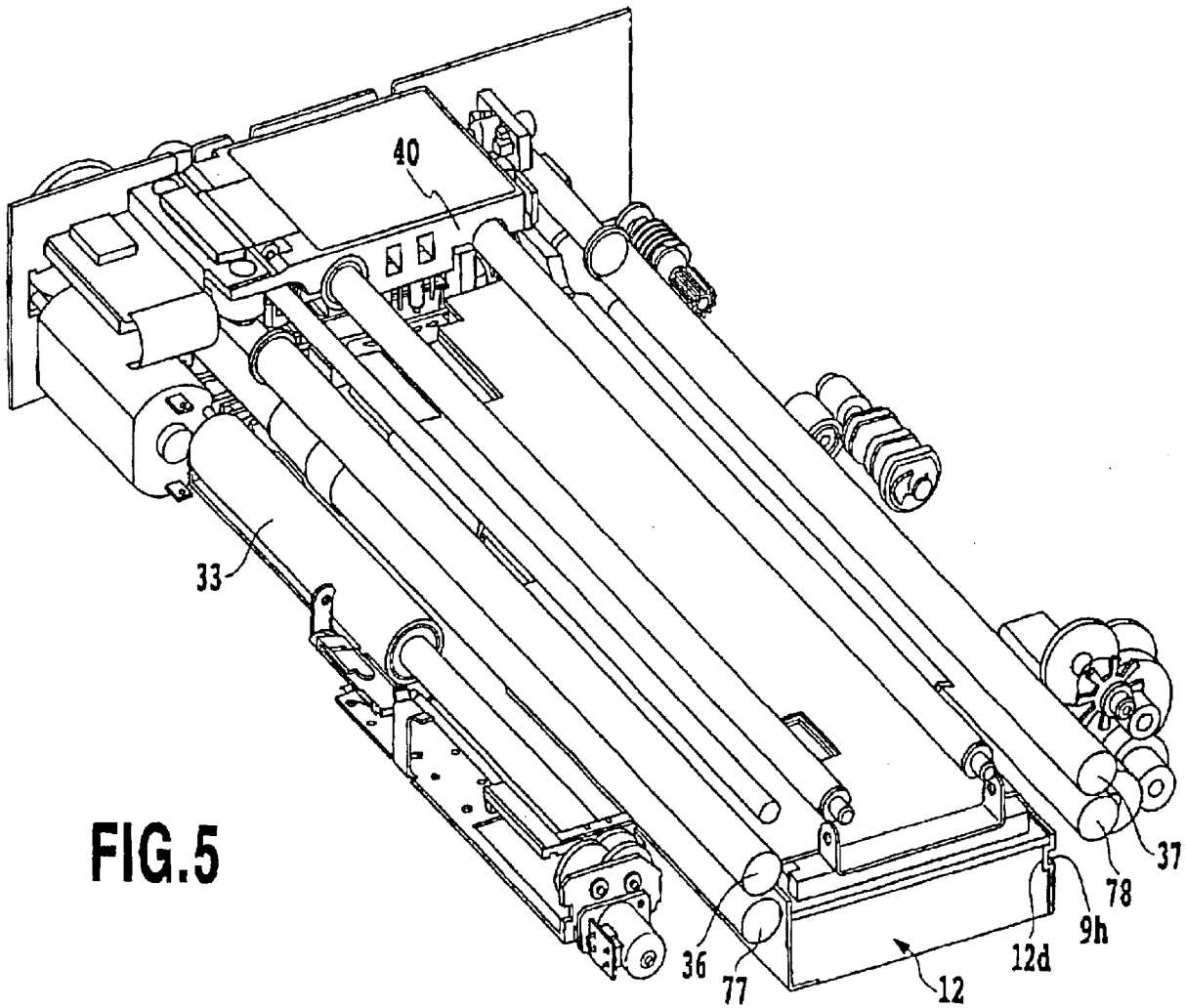
FIG. 5 is a perspective view of the print mechanism in FIG. 3.

FIG. 3 is an enlarged plan view showing the configuration in FIG. 1, notably a print mechanism. FIG. 4 is a plan view illustrating the printer with a carrier mechanism in FIG. 5 removed. FIG. 5 is a perspective view of the print mechanism.

Figure 6:
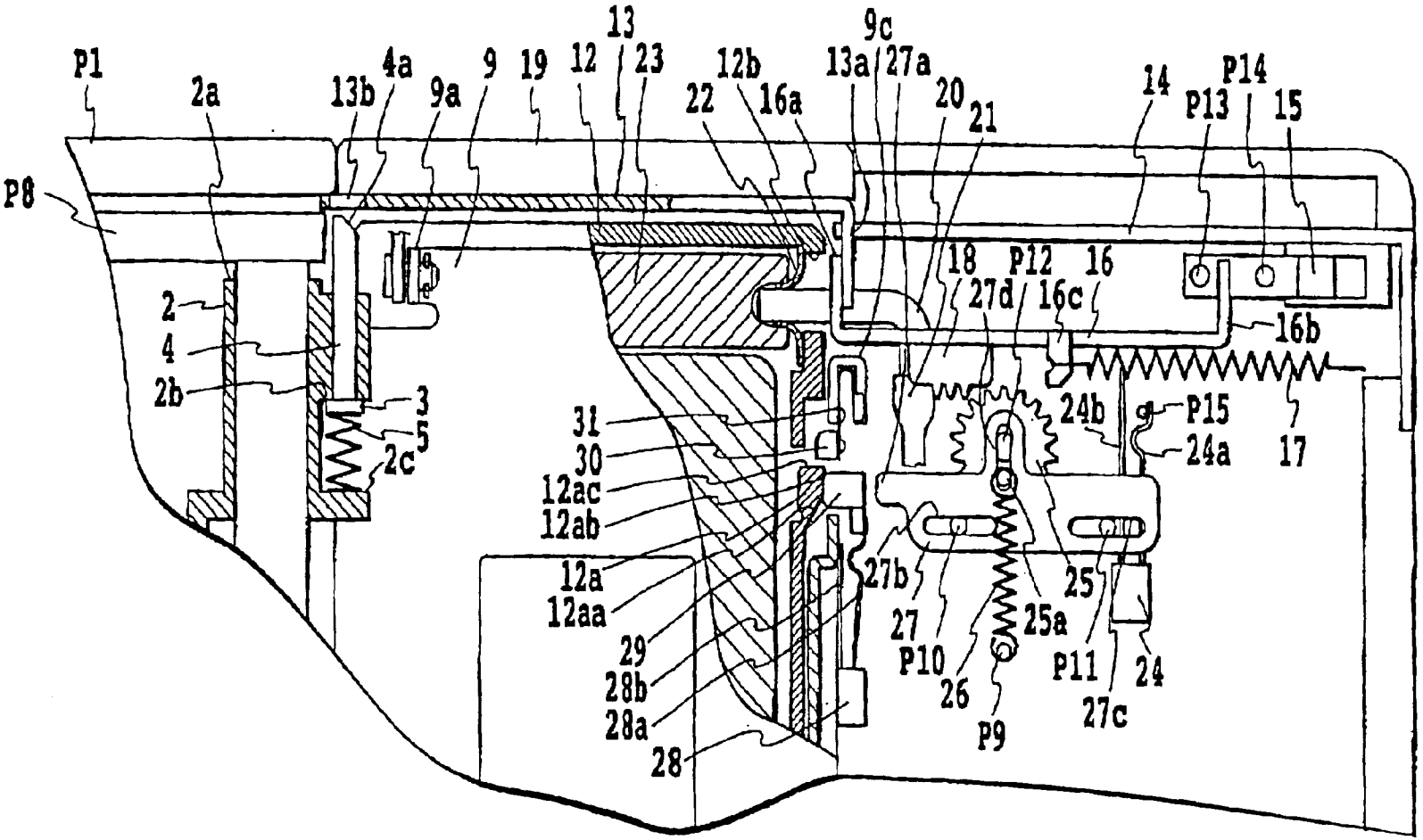
FIGS. 6 to 8 are partly enlarged plan views of the print mechanism, illustrating, in further detail, the operation of replacing the ink cartridge according to the first embodiment.

In the present example, an ink cartridge accommodating ink as a print agent is slidably installed in the print mechanism in the same direction along the scan direction of a carrier 40. In the present configuration, an opening and closing lid 19 in FIG. 6 is fully opened to open an installation port. Then, the ink cartridge 12 is slidably installed through the installation port of the lid side.

In FIG. 3, reference numeral 2 denotes a lock slider slidably fitted over a pinch roller 37 that presses the print sheet P6 against a conveying roller 78 shown in FIG. 5 to exert a conveying force when the sheet is conveyed. The lock slider 2 has a lock pin 4 used to prevent a lid guide plate 13 from sliding inadvertently, the lid guide plate 13 being integrated with the opening and closing lid 19, which is opened and closed when the ink cartridge 12 is replaced. The lock slide 2 slidably moves to cause the lock pin 4 to slip out of the lid guide plate 13 to allow the opening and closing lid 19 to be opened and closed. Further, the lock pin 4 is programmed to return to the locked position when the opening and closing lid 19 is fully opened. When the opening and closing lid 19 is closed again, the lid guide plate 13 pushes a slope portion 4*a* (shown in FIG. 4) of the lock pin 4 to slidably move the lock pin. When the opening and closing lid 19 is fully closed, the lock pin 4 is fitted into a hole portion 13*b* (shown in FIG. 4) in the lid guide plate 13 to lock the opening and closing lid 19. A contact 3 is integrated with the lock pin 4 and also used to prevent the lock pin 4 from slipping out. The contact 3 is always urged toward a terminal portion 2*b* (see FIGS. 4 and 6) of the lock slider 2 by a spring 5. When the opening and closing lid 19 is closed, the lock pin 4 moves toward the spring 5 by the lid guide plate 13. Thus, the contact 3 is released from its contact state with the terminal portion 2*b*. Then, once the opening and closing lid 19 is fully closed and locked, the contact 3 is brought into contact with the terminal portion 2*b* again. The main IC, described later, allows it to be checked how the contact 3 is in contact with the terminal portion 2*b*.

Reference numeral 14 denotes a decorative panel that serves as a screen when the opening and closing lid 19 is closed. As shown in FIGS. 4 or 6, the decorative panel 14 guides an interlocking portion 13*a* of the lid guide plate 13. Reference numeral 15 denotes a click spring for locking the opening and closing lid as is fully open. The click spring 15 is fixed to the printer main body using a calking shafts P13 and P14. When the interlocking portion 13*a* of the lid guide plate 13 climbs over a convex portion the click spring 15, it is clicked and locked on the click spring 15 (see FIGS. 6 and 8).

In FIG. 4, reference numeral 110 denotes an interlocking member attached to a lift slider 58 using its flange portion 110*a*. The lift slider 58 may be moved along a lead on a shaft 57. The interlocking member 110 is provided with a hook portion 110*b* at its tip opposite to the flange portion 110*a* so that the hook portion 2*d* of the lock slider can engage with the hook portion 110*b*. A compression spring 111 is disposed between the hook portion 2*d* and the flange portion 110*a*. The spring force of the compression spring 111 is set to be stronger than that of the spring 5, which presses the lock pin 4. Then, if the lock pin 4 is pushed when the opening and closing door 19 is closed, the spring 5 can be surely compressed to moved the lock pin 4 toward the spring 5 to release the contact 3 from the terminal portion 2*b*. Further, in the condition in FIG. 4, when the slider 58 moves away from the opening and closing lid 19, the lock slider 2 moves the distance as that the lift slider 58 has moved, in the same direction as that in which the lift slider has moved because the hook portion 110*b* is engaged with the hook portion 2*d*. Consequently, the opening and closing lid 19 is unlocked.

(Interior Construction of Ink Cartridge)

Figure 9:
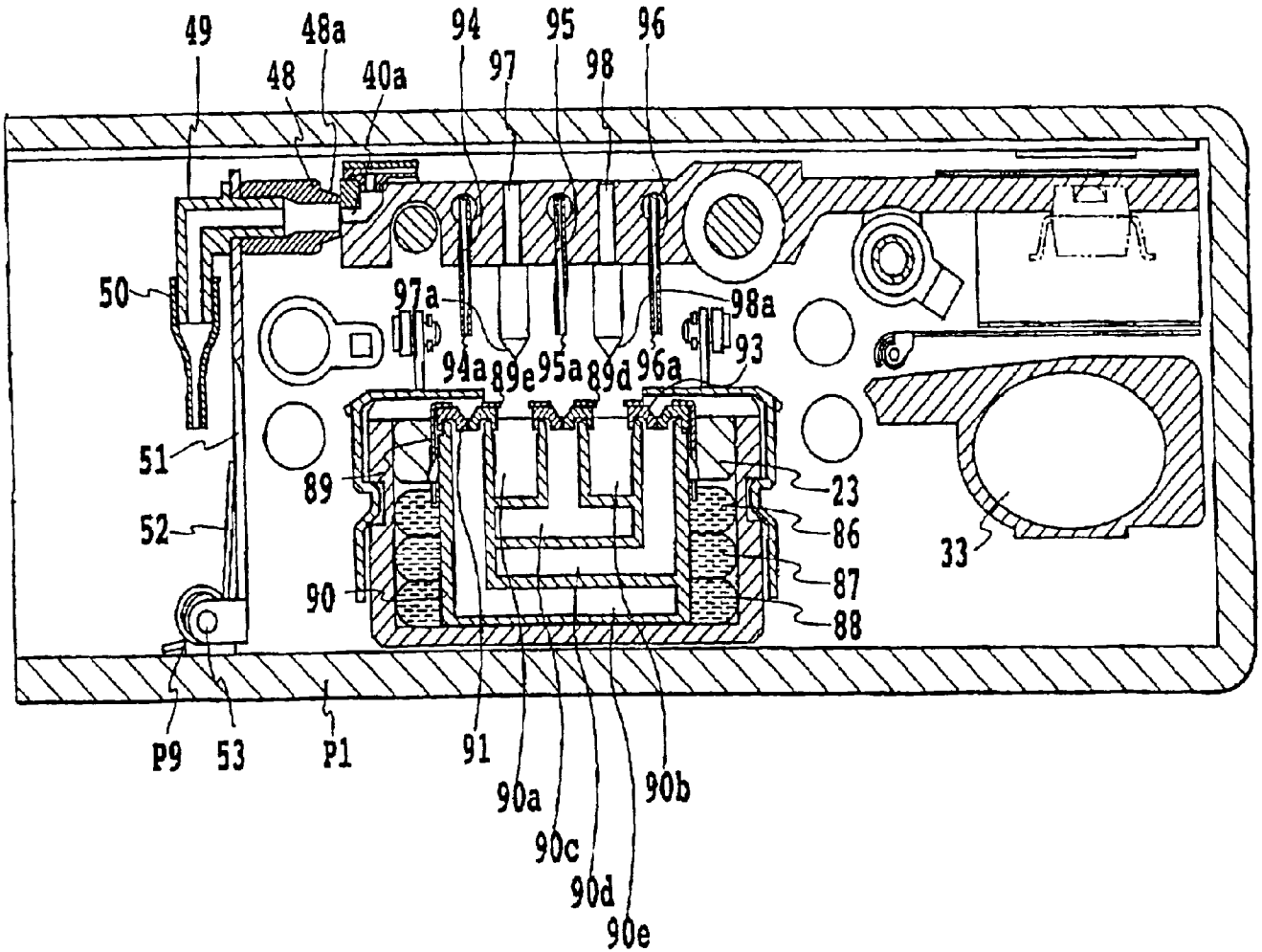
FIG. 9 is a side sectional view taken along the printing medium conveying direction and showing the print mechanism to illustrate a configuration of ink supply parts and the like in the print mechanism of the printer according to the first embodiment.
Figure 11:
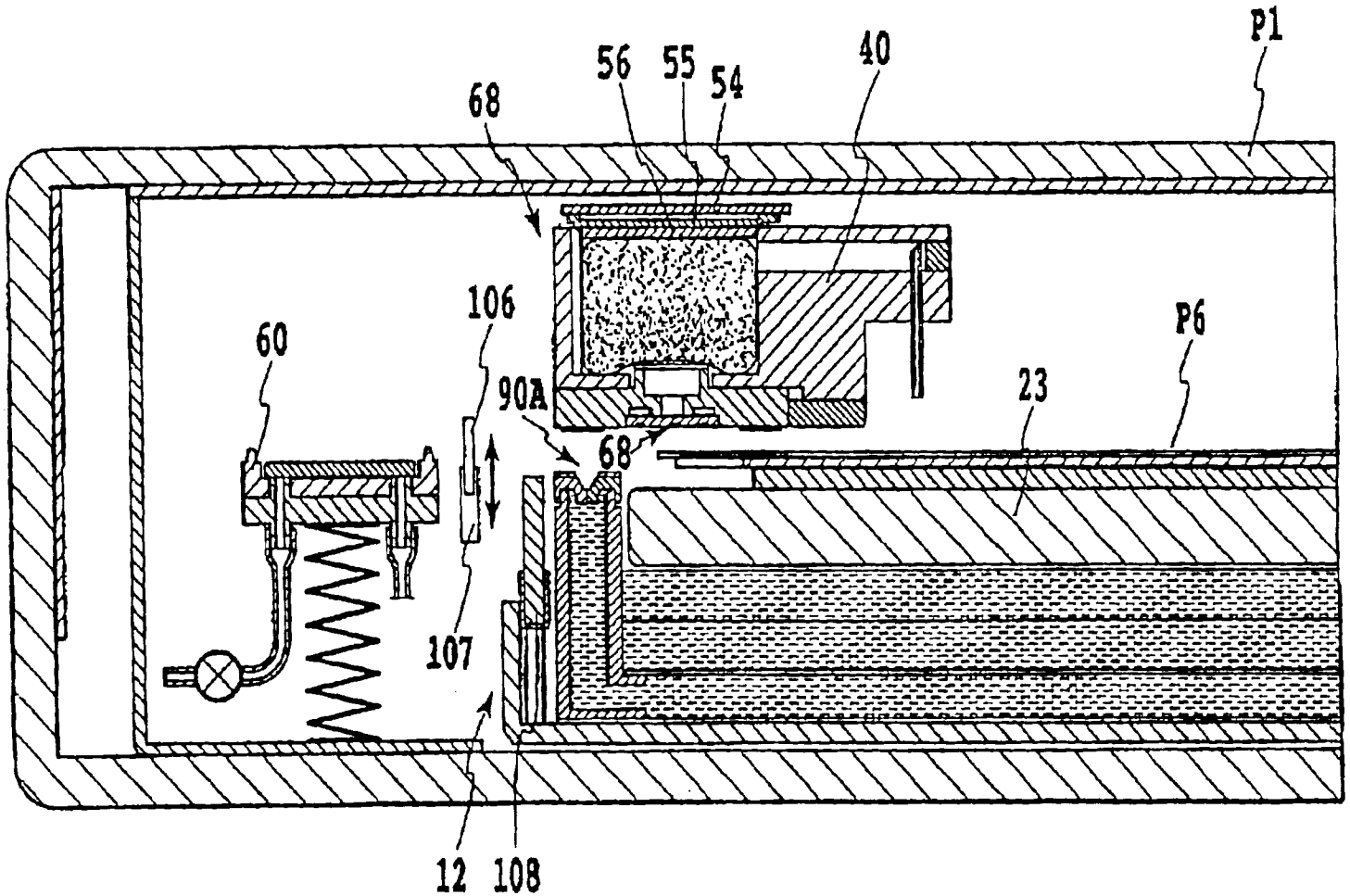
FIG. 11 is an enlarged sectional views taken along the carrier scanning direction.
Figure 14:
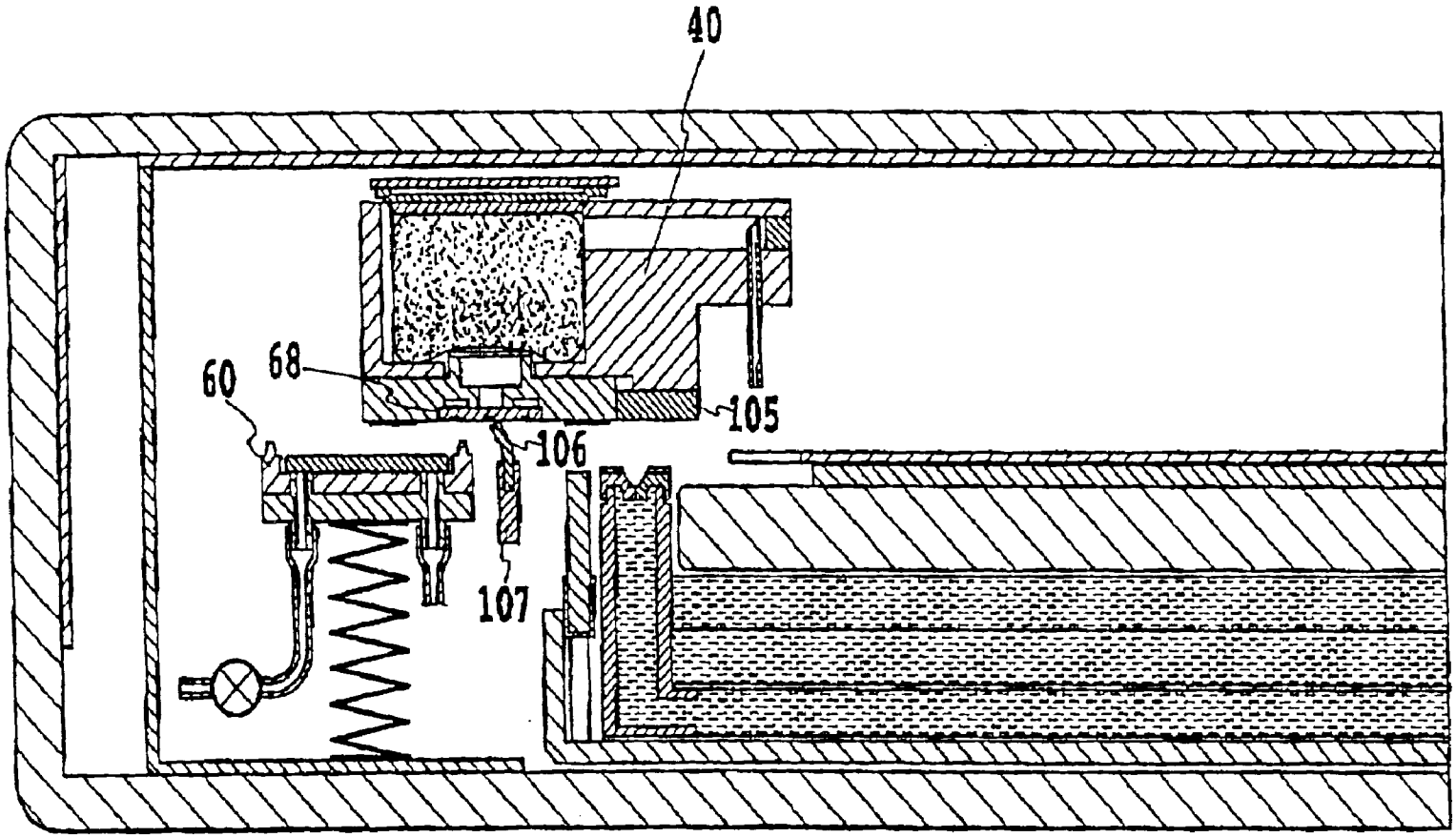
FIGS. 14 and 15 are sectional views to illustrate cleaning operations for a printing head and a wiper.
Figure 16:
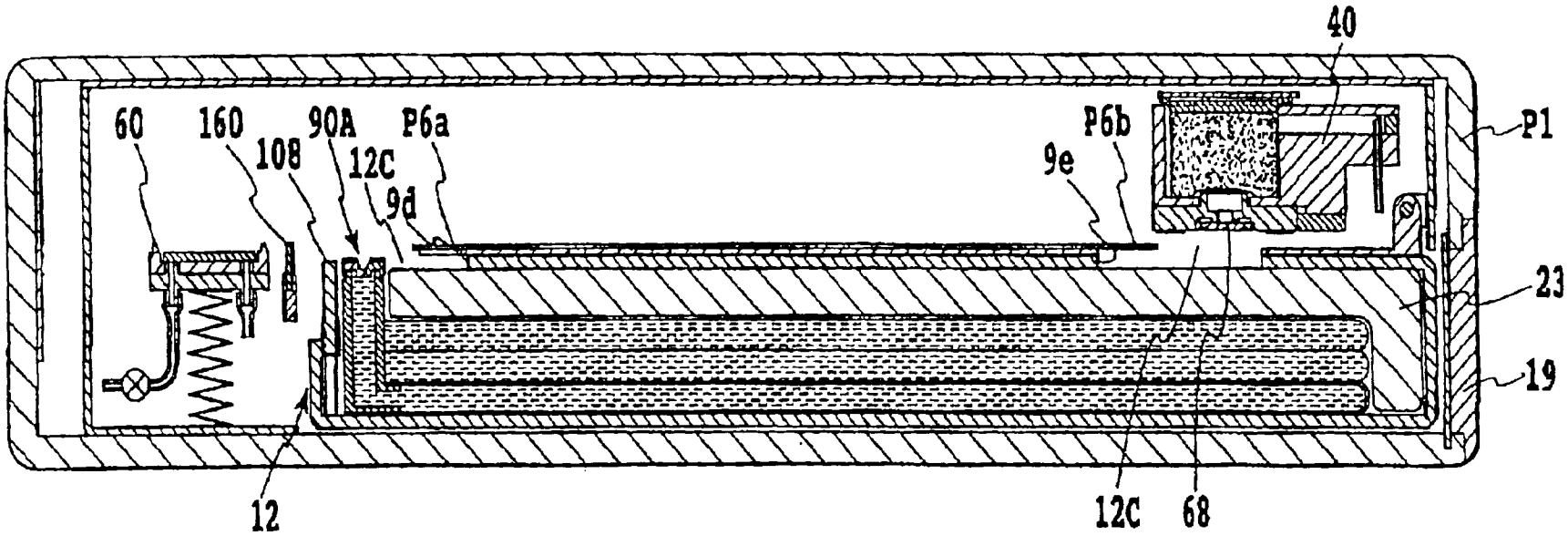
FIG. 16 is a sectional view taken along the carrier scanning direction.

In the ink cartridge 12 located on the area opposite the scanning area of the printing head, as shown in FIGS. 9 and 2, receives a waste ink absorber 23 therein and ink bags 86, 87, 88 which are connected to the joint case 90. This ink absorber 23, as shown in FIGS. 11 and 16, is adapted for collecting ink ejected to the outside of the width of the printing medium in order for performing a printing on the entire printing medium when printing head performs a scanning to print. The ink cartridge 12, as shown in FIGS. 14 and 16, is provided with an openings 12*c* through which ink is collectable. The joint case 90 is provided with the joint rubbers 91, 92, 93 corresponding to each ink path from the ink bags 86, 87, 88. The joint rubbers are press fitted on the pressure plate 89 so that ink leakage may not occur. It is a matter of course that the number of the ink bags corresponding to the ink colors, density and the like should be prepared.

Figure 12:
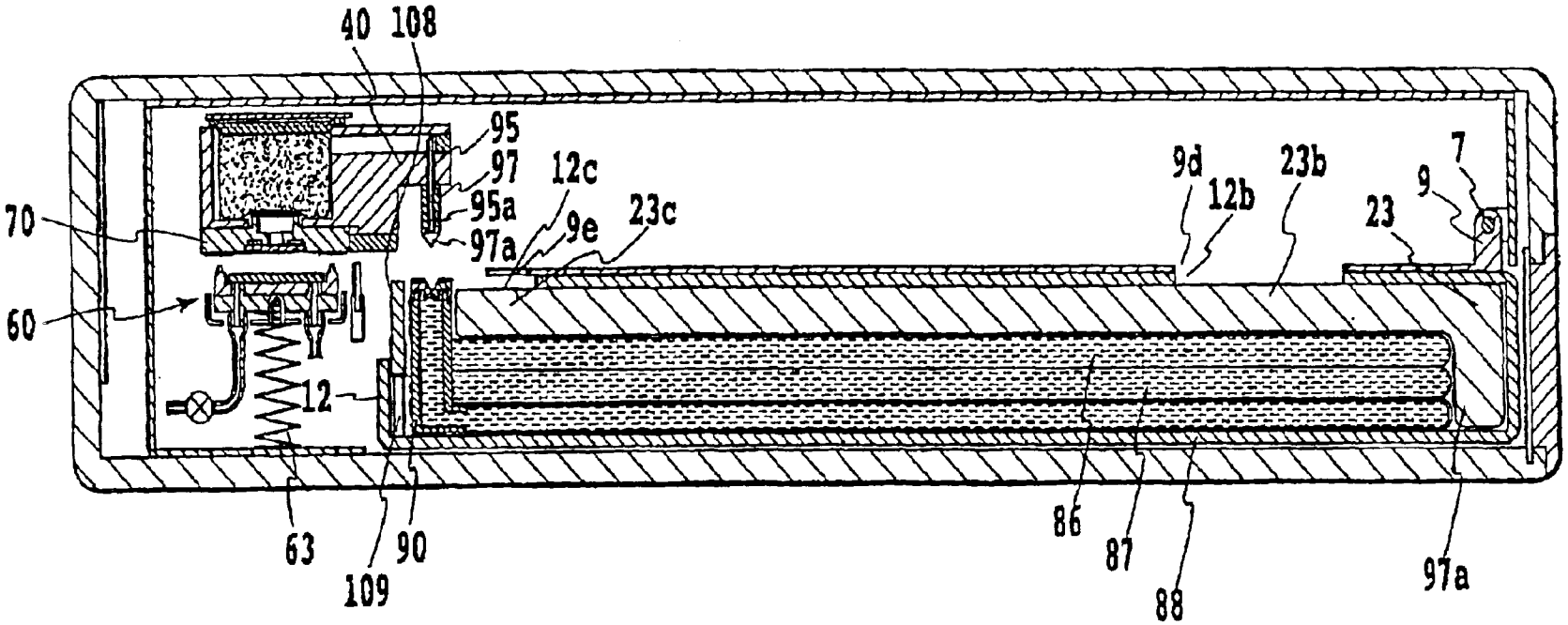

Further, as shown in FIG. 4 or FIG. 12, a wiper ink absorbing pad 108 is attached adjacent to the joint case 90 in a condition that to be held by a pad holder 109, resulting in being movably supported in the direction inward the ink cartridge 12. Still further, as shown in FIG. 6, in order to absorb waste ink produced by a recovery operation of the printing head 68, a drain hole 12*b* formed to be a long hole and connectable to the waste ink absorber is provided. Back-flow prevention film 22 is set inside of the drain hole 12*b* so that the drain pipe 20 can be inserted.

(Ink Cartridge Installing Mechanism and Sensing Mechanism)

Figure 7:
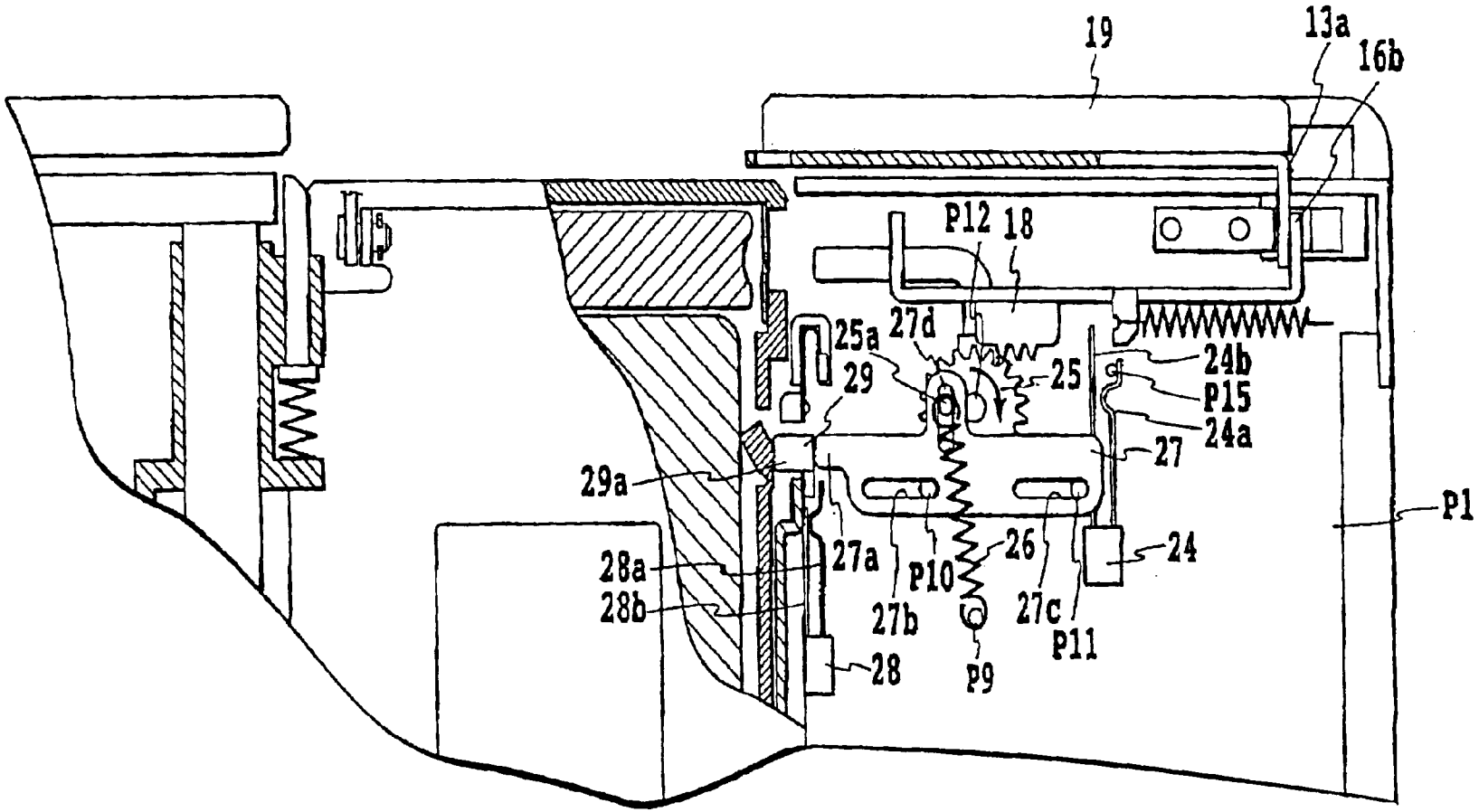
Figure 8:
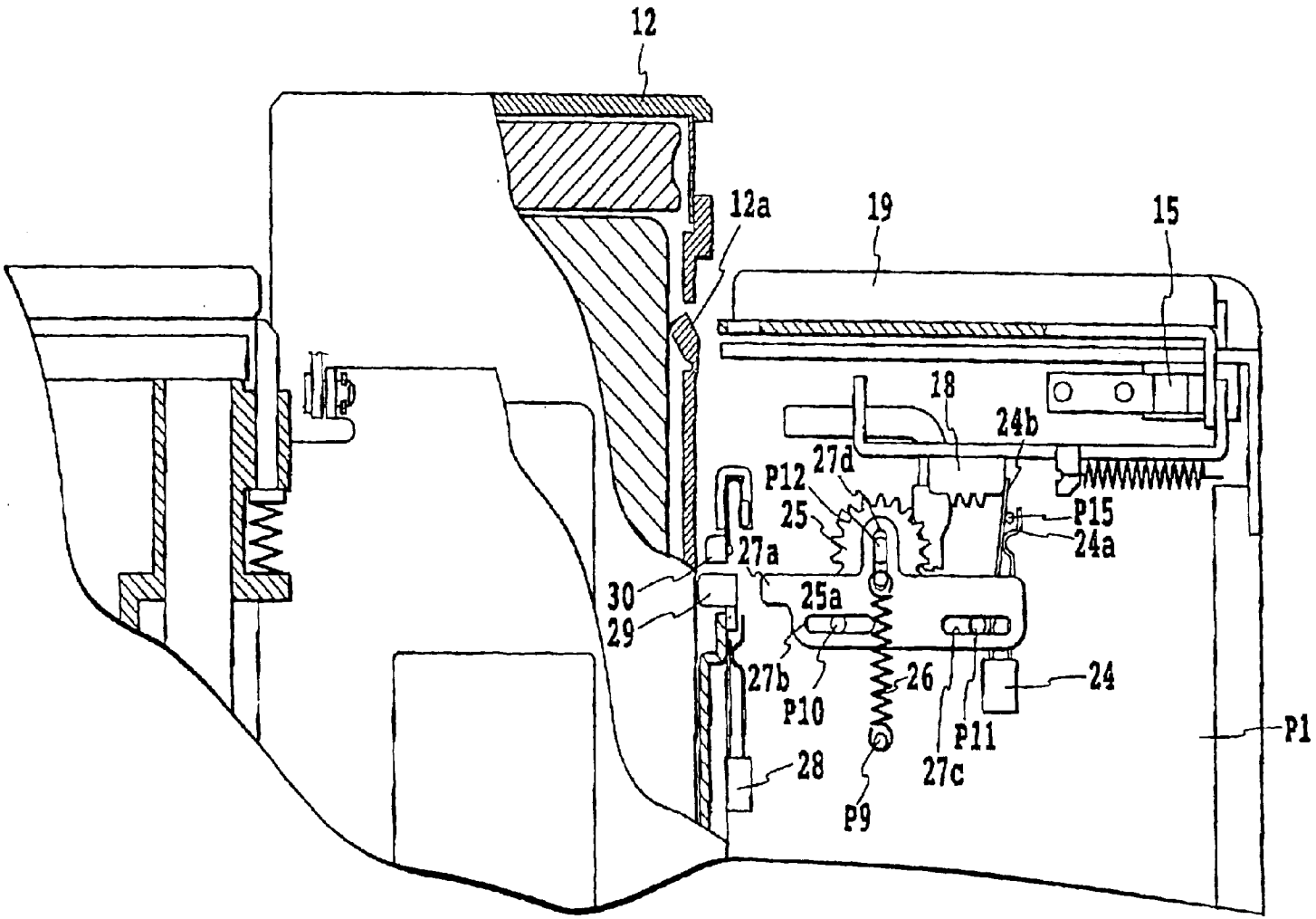

Reference numeral 24 shown in FIGS. 3, 4 and 6 to 8 denotes a full open switch sensing that the opening and closing lid 19 is fully open. A contact piece 24*a* of the full open switch 24 is positioned by the pin P15, fixed to the printer main body P1. On the other hand, when the opening and closing lid 19 is fully opened as shown in FIG. 8 to cause a rack gear 18 to push a movable contact piece 24*b*, thereby it comes into contact with the contact piece 24*a* to turn the switch 24 on.

A toggle gear 25 shown in FIGS. 3, 4 and 6 to 8 is rotatably supported by a rotating shaft P12, fixed to the printer main body P1. A drive pin 25*a* fitted into a slot 27*d* in an interlocking lever 27 is disposed at a position corresponding to a radius smaller than a pitch circle radius with which the rack gear 18 is engaged. A toggle spring 26 is connected to the drive pin 25*a*. The toggle spring 26 is extended between the drive pin 25*a* of the toggle gear 25 and a shaft P9 fixed to the printer main body P1. The toggle spring 26 is made to be stable in a manner as shown in FIG. 6. When the opening and closing lid is opened, the movement thereof cause the rack gear 18 to move, then the toggle gear 25 is rotated clockwise as shown in FIG. 7 by an arrow. When the opening and closing lid is closed, the movement thereof cause the rack gear 18 to move, then the toggle gear 25 is rotated counterclockwise (this motion is not shown) to disengage it from the rack gear 18, it returns to the condition in FIG. 6 owing to the force of the toggle spring 26.

As shown in FIG. 2, when the ink cartridge 12 is slidably installed in the printer main body P1, convex guide portions gh and gi of a platen 9 are fitted into concave guide portions 12*d* and 12*e*, respectively, of the ink cartridge 12 for positioning (only the guide portion 12*d* is shown in FIG. 5.). A projection 12*a* for indicating that an ink cartridge is unused condition is disposed at a lip portion of the concave guide portion 12*e* for positioning as shown in FIG. 6, the projection 12*a* being referred to as an "unuse-indicating projection". As shown in FIG. 6, a flat surface 12*ad* of a convex portion located at the top of the unuse-indicating projection 12*a* is flush with an outer surface of the ink cartridge 12 not to be protruded therefrom. This prevents a user from inadvertently folding the unuse-indicating projection 12*a* with his or her finger when installing the unused ink cartridge 12 in the printer.

Figure 10:
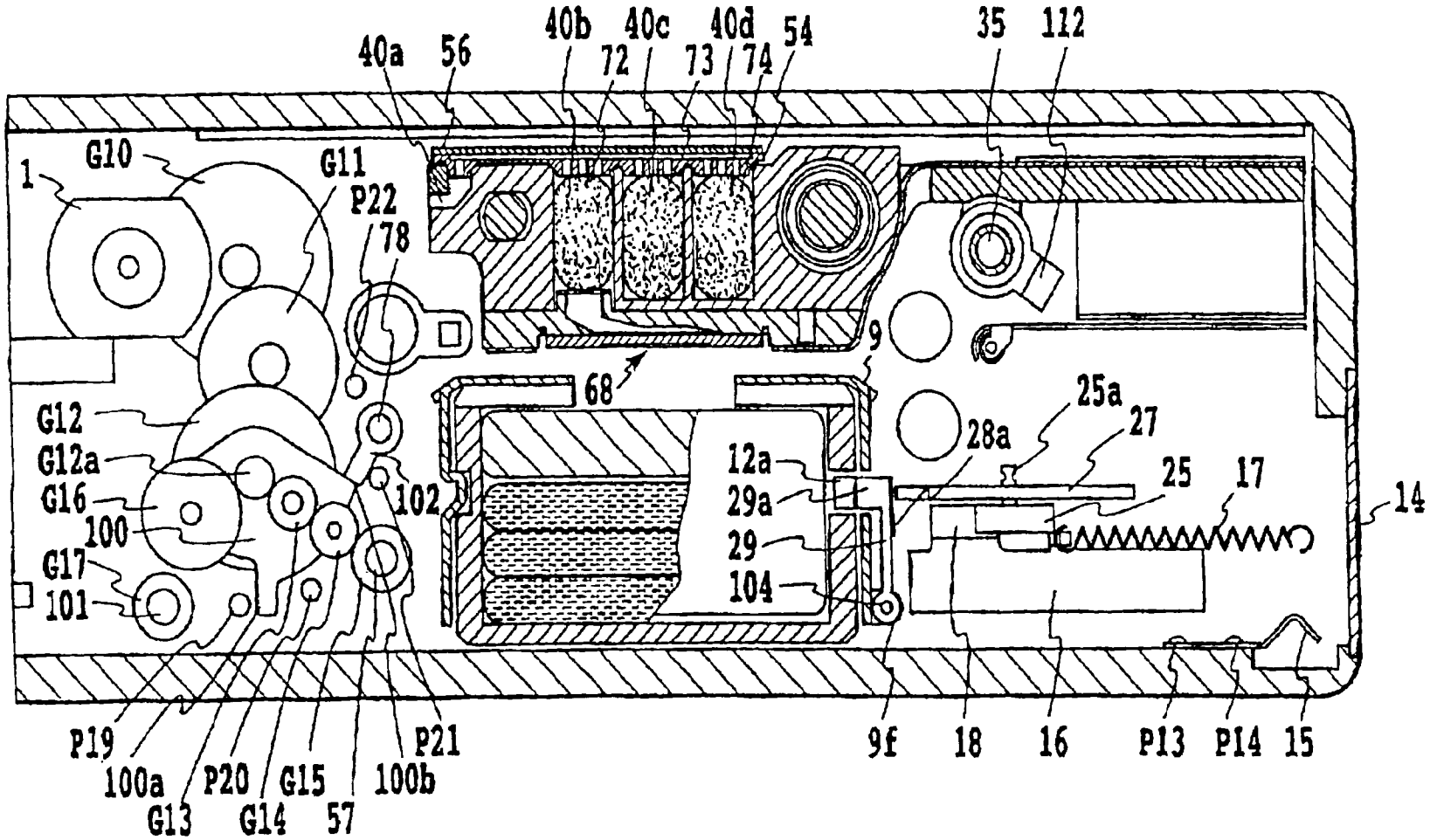
FIG. 10 is an enlarged sectional view taken along a carrier scanning direction and showing a part of the print mechanism to illustrate a configuration of an ink cartridge installing section, a transmission mechanism for lifting up the ink cartridge, and the like in the print mechanism.

Reference numeral 28 as shown in FIG. 4 denotes a presence or absence sensing switch of the ink cartridge 12 which is installed in the platen 9. Reference numeral 29 is a sensing lever 29 and, as shown in FIG. 10, is supported so as to rotate around the rotating shaft 104 by a shaft receiving portion 9*f* of the platen 9. Once an unused ink cartridge 12 is installed, since an unuse-indicating projection 12*a* is not yet bended, this unuse-indicating projection 12*a* pushes the convex portion 29*a* of the sensing lever 29 to cause a clockwise rotation as shown in FIG. 10 against a spring force of a movable contact piece 28*a* of the presence or absence sensing switch to separate the movable contact piece 28*a* from a fixed contact piece 28*b*, thereby turning off the presence or absence sensing switch. The main IC, described later, can recognize this condition as the one in which the ink cartridge 12 has been newly installed.

As shown in FIG. 7, as the lid 19, allowing the ink cartridge 12 to be removed, is opened, the interlocking lever 27 is moved to push and move the sensing lever 29 as described above, thereby the unuse-indicating projection 12*a* is folded and plastically deformed. The unuse-indicating projection can no longer be returned. Further, at this time, the presence or absence sensing switch 28 is turned on again, because a movable piece 28*a* thereof is in contact with a fixed piece 28*b*, as shown in FIG. 8. If the ink in the ink cartridge 12 is consumed up, the opening and closing lid 19 is fully opened. Even if the ink cartridge 12 is removed, the presence or absence sensing switch 28 remains on. Further, even if the ink cartridge 12 in which no ink is contained is removed and then installed again, the presence or absence sensing switch 28 is not turned off. Thus, in this case, ink remaining amount storage information (information indicating that ink has been consumed up) for the printer is not reset so that this ink cartridge can be distinguished from an unused one. Furthermore, naturally enough, if the opening and closing lid is fully opened as shown in FIG. 8 but the ink cartridge 12 with no ink is not removed, the presence or absence sensing switch 28 is not turned off. Accordingly, the main IC can detect that the ink cartridge 12 has not been replaced. This prevents the ink cartridge with its ink consumed up from being mistaken for an unused cartridge to inconveniently cause a blur during printing.

As shown in FIG. 10, the sensing lever 29 is supported by bearing portions 9*f* and 9*g* of the platen 9 so as to be rotatable around the rotating shaft 104. If an unused ink cartridge 12 is installed, an unuse-indicating projection 12*a* pushes a convex portion 29*a* of the sensing lever 29 because the unuse-indicating projection 12*a* has not been folded. Then, the convex portion 29*a* is rotated clockwise in FIG. 10 against the spring force of the movable contact piece 28*a* of the presence or absence sensing switch. The movable contact piece 28*a* is thus separated from the fixed contact piece 28*b* to turn off the presence or absence sensing switch.

Reference numeral 30 shown in FIG. 4 or 6 denotes a stopper member that prevents the ink cartridge 12 from slipping out. As shown in FIG. 6, the stopper member 30 is attached to a generally U-shaped leaf spring 31 and is set on a generally U-shaped portion of the platen 9. As installation of an unused ink cartridge 12 proceeds in the installing section of the printer, the stopper member 30 is pushed by a slope portion 12*aa* of the unuse-indicating projection 12*a*. At the same time, the leaf spring 31 is flexed. When the installation of the cartridge 12 is completed, the reaction force of the leaf spring 31 returns the stopper member 30 to its original position. Then, in this state, even if an attempt is made to remove the ink cartridge 12, an end 12*ac* of the unuse-indicating projection 12*a* abuts against the stopper member 30. Accordingly, the installed ink cartridge 12 is prevented from being inadvertently removed or slipping out.

On the other hand, when only a little or no ink remains in the ink cartridge 12 and the latter is thus replaced, the opening and closing lid 19 is opened to cause the convex portion 27*a* of the interlocking lever 27 to push the sensing lever 29. Accordingly, as shown in FIG. 7, the convex portion 29*a* folds or cuts the unuse-indicating projection 12*a*. Consequently, the end 12*ac*, which has been abutted against the stopper member 29, moves away. Further, a surface 12*ab*, which has been abutted against the sensing lever 29, acts as a tapered face to engage with the stopper member 30 to flex the leaf spring 31. Therefore, even if the unuse-indicating projection 12*a* is insufficiently folded, no problem occurs when the ink cartridge 12 is removed. Furthermore, if the unuse-indicating projection 12*a* is cut when folded, nothing abuts against the stopper member 30. It should thus be appreciated that the ink cartridge 12 can be properly removed.

In the present embodiment, the ink cartridge 12 has a housing made of resin molding. However, the material for the housing may be metal. It is needless to say that an appropriate material may be used provided that the unuse-indicating projection 12*a* can be similarly folded. Further, instead of being integrated with a case, the ink cartridge 12 may be constructed by combining separate parts with each other.

(Coupling of the Platen and Ink Cartridge)

In FIG. 3, reference numeral 1 denotes a motor used to drive a sheet feeding roller. A mechanism described later switches a path through which the driving force of the motor 1 is transmitted, to drive a mechanism that lifts up the ink cartridge.

In FIG. 3, reference numeral 6 denotes a hinge plate fixed to the printer main body P1. As described later, the hinge plate 6 is a member used to lift up the platen 9 together with the ink cartridge 12. Pins 7 and 10 are projected from the hinge plate 6. The pins 7 and 10 are loosely fitted into parts 9*a* and 9*b*, respectively, of the platen 9 so as to act as pivots when the platen is lifted up. Reference numerals 8 and 11 denote looking washers that prevent the pins 7 and 10 from slipping out.

The platen 9 is a reference plate against which sheets are pressed to flatten their printing surfaces. In the present example, as described above, the opening and closing lid 19 is fully opened to form an installation port through which the ink cartridge 12 can be slidably installed. At this time, as shown in FIG. 5, convex guide portions 9*h* and 9*i* used as a positioning reference are fitted into concave guide portions 12*d* and 12*e*, respectively, of the ink cartridge 12 to establish an installed state. Consequently, when the pins 7 and 10 are used as the pivots to lift up the platen 9 in order to supply ink as described later, the ink cartridge 12 is lifted up integrally with the platen 9. Further, the platen 9 is formed with openings 9*d* and 9*e* so that ink ejected to the outside of a sheet can pass through the openings 9*d* and 9*e* when the entire surface of the sheet is printed (full bleed print). Further, the ink cartridge 12 is formed with openings 12*c* aligned with the openings 9*d* and 9*e*, respectively, in the platen 9 when it is completely installed. Accordingly, ink ejected to the outside of a sheet may pass through the openings to be received by a waste ink absorber in the ink cartridge 12.

On the other hand, as shown in FIGS. 3 or 6, the printer main body P1 is provided with a drain guide plate 16 that is supported by the printer main body P1 so as to slidable in the same direction as that in which the lid guide plate 13 moves slidably. As shown in FIG. 6, a spring 17 is extended between a hook portion 16*c* of the drain guide plate 16 and the printer main body P1 to always urge the opening and closing lid 19 in a direction in which it is open. Further, an interlocking portion 16*a* or 16*b* abuts against the interlocking portion 13*a* of the lid guide plate 13. As described above, the rack gear 18 is fixed to the drain guide plate 16. Sliding movement of the drain guide plate 16 engages only a rack gear portion (in FIG. 6, only three teeth) with the toggle gear 25 to rotate the toggle gear 25 by a predetermined amount.

As shown in FIG. 6, the drain pipe 20 is generally L-shaped and is fixed to the drain guide plate 16. One end of the drain pipe 20 is connected to a cylinder pump 33 shown in FIG. 6 via a tube 21. When the ink cartridge 12 has been installed and the opening and closing lid 19 has been closed, as shown in FIG. 6, the other end of the drain pipe 20 is inserted into the waste ink absorber 23 in the ink cartridge 12. In this condition, waste ink can be discharged.

(Main Scanning Mechanism and Printing Head)

In FIG. 3, the reference numeral 35 denotes a lead screw which is a member for performing a reciprocate scan drive for a carrier 40 incorporating the printing head 68 therein in the orthogonal direction (main scanning direction) to a sheet feeding direction (sub scanning direction). The lead screw 35 is rotatably driven by a driving force conveyed from the driving motor 41 to a screw gear, not shown, press fitted into a shaft of the lead screw 35 through a pinion gear G6 press fitted into a motor shaft and idler gear, not shown. The lead screw 35 and the carrier 40 are connected each other through a lead piece 112, which is engaged in a hole portion 40*e* of the carrier 40 to be pressed in the scanning direction of the carrier 40 by a spring 113 and a portion thereof engages a groove of the lead screw 35, resulting in a reciprocate movement of the carrier 40 associating with the rotation of the lead screw 35. The lead piece 112 for the lead screw 35 in this embodiment is featured in that the carrier 40 is controlled of its attitude by the main shaft 42 and the guide shaft 46 to perform a reciprocate movement, so that the lead piece 35 is essential for the present embodiment in connecting it with the lead screw 35 as the third shaft.

The carrier 40 carrying the printing head 68 (see FIG. 10) is provided with a shaft receiving member on which are formed a shaft receiving pipe 44 and a shaft receiver 43, 45 all in one as a fitting portion with the main shaft 42. The carrier 40, as shown in FIG. 10, is provided with tank sections 40*b*, 40*c*, 40*d* for storing print inks and into each of which is injected with an ink such as yellow, magenta, cyan, at an appropriate timing during printing. An interior of the tank sections 40*b*, 40*c*, 40*d* contains sponges 72, 73, 74 respectively for the use of ink impregnation. Further as shown in FIG. 11, each ink tank is bonded with a resin lid 54 and a lid member 56 is designed to allow a gas flow at a suction port 40*a* through a membrane for separating gas and liquid (hereinafter, referred to as gas-liquid separating membrane) (see FIGS. 9 and 10).

The printing head 68 has an array of ejection ports arranged in the direction different from the main scanning direction (ex. sub scanning direction). The number of array of ejection ports corresponds to the number of ink colors to be used which are arranged in parallel in main scanning direction.

As shown in FIG. 9, the ink supplying needle 94, 95, 96 each is press fitted into the carrier 40 so as to adapt for forming an independent flow path on respective ink tanks 40*b*, 40*c*, 40*d*. Each of the positioning pins 97, 98 has a conical portion 97*a* ad 98*a* at its end. The conical portions 97*a*, 98*a* are designed to be positioned at lower position than the end of the ink supplying needle, and, as will be described later, as the platen 9 and the ink cartridge 12 are lifted up, the conical portions 97*a*, 98*a* of the end of the positioning pins 97, 98 are inserted into corresponding 89*e*, 89*d* placed on the pressure plate 89 to be positioned prior to the ink supplying needles 94, 95, 96. Hence, the ink supplying needles 94, 95, 96 each can be correctly inserted into corresponding joint rubber 91, 92, 93.

(Lift-Up Mechanism)

The present embodiment employs an intermittent supply method in which the ink tanks 40*b*, 40*c* and 40*d* communicated with a printing head 68 are intermittently supplied with ink from the ink cartridge 12 as required. In the present embodiment, the intermittent supply operation is performed such that the ink cartridge 12 is lifted up to couple to the mechanisms of the printer main body as described above, and then ink is injected into the ink tanks 40*b*, 40*c*, and 40*d* on the carrier 40. A mechanism for lifting up the ink cartridge 12 will described below.

In FIG. 2, reference numeral 57 denotes a lead screw that allows a lift slider 57 to move slidably for a lift-up operation.

The lead screw 57 is rotatively driven by using a planetary gear mechanism such as that shown in FIG. 10 to switch a power transmission path for the driving force of the sheet feeding motor 1 (FIG. 1) as a driving source for feeding a sheet P6.

First, the planetary gear mechanism will be described. In FIGS. 3 and 10, a pinion gear G9 is pressed into a shaft of the sheet feeding motor 1. The power of the motor 1 is transmitted to a sun gear G12 via reduction gears G10 and G11 and further to a planetary gear G16 via a small gear G12*a* that is concentric with the sun gear G12. On the other hand, the power of the motor 1 is transmitted from the small gear G12*a* to a planetary gear G14 via a planetary gear G13. In the state shown in FIG. 10, the planetary gear G16 is separated from a transmission gear G17 and runs idly. In contrast, a planetary gear G14 coupled to the planetary gear G13 is engaged with a transmission gear G15 attached to the lead screw and can thus transmit power.

Each of the planetary gears G16, G13, and G14 is rotatably supported by a shaft provided in a rotating plate 100. The planetary gear G16 is provided with a spring to cause rotational friction between the sun gear 12 and the rotating plate 100 concentric therewith. The rotating plate 100 rotates in the same direction as the rotating direction of the sun gear G12 with a specified amount of friction. The rotating plate 100 is provided with an extended portion 100*a* so as to rotatively move between stopper pins P19 and P20 fixed to the printer main body P1. Further, the rotating plate 100 is provided with a cam surface 100*b*. When a lever 102 provided at an end of a conveying roller 78 is abutted against the stopper pin P21, the cam surface 100*b* abuts against the lever 102 to hinder the rotating plate 100 from rotating clockwise in unison with the clockwise rotation of the sun gear G12. In the state shown in FIG. 10, the lead screw 57 can be rotated forward and backward by the motor 1. Here, the lever 102 is rotatably fitted into the conveying roller 78. Further, a friction spring (not shown) is provided between the lever 102 and a gear supporting side plate P8 fixed to the printer main body P1. When the conveying roller 78 is rotated counterclockwise, the lever 102 abuts against the stopper pin P21 as shown in FIG. 10. When the conveying roller 78 is rotated clockwise, the lever 102 abuts against the stopper pin P22. Of course, the stopper pins P21 and P22 are fixed to the printer main body P1.

The lift slider 58 can move slidably in a direction parallel with the scan direction of the printing head when the lead screw 57 is rotated forward or backward as described previously. As shown in FIG. 4, the left slider 58 is provided with cam surfaces 58*a* and 58*b* that join or separate a suction joint 48 in FIG. 3 to or from the carrier 40. Further, the lift slider 58 is provided with a lift cam 58*c* to lift up the platen 9. A lift pin 9*f*, fixed to the platen 9, is engaged with the lift cam 58*c*. Moreover, the lift slider 58 is provided with a cap cam 58*d* to set or remove a suction cap 60 on or from the printing head 68*a* mounted on the carrier 40. The cap cam 58*d* is engaged with an engaging portion 59*a* of a cap holding plate 59 that holds the suction cap 60 and a cap base 62 together.

Figure 13:
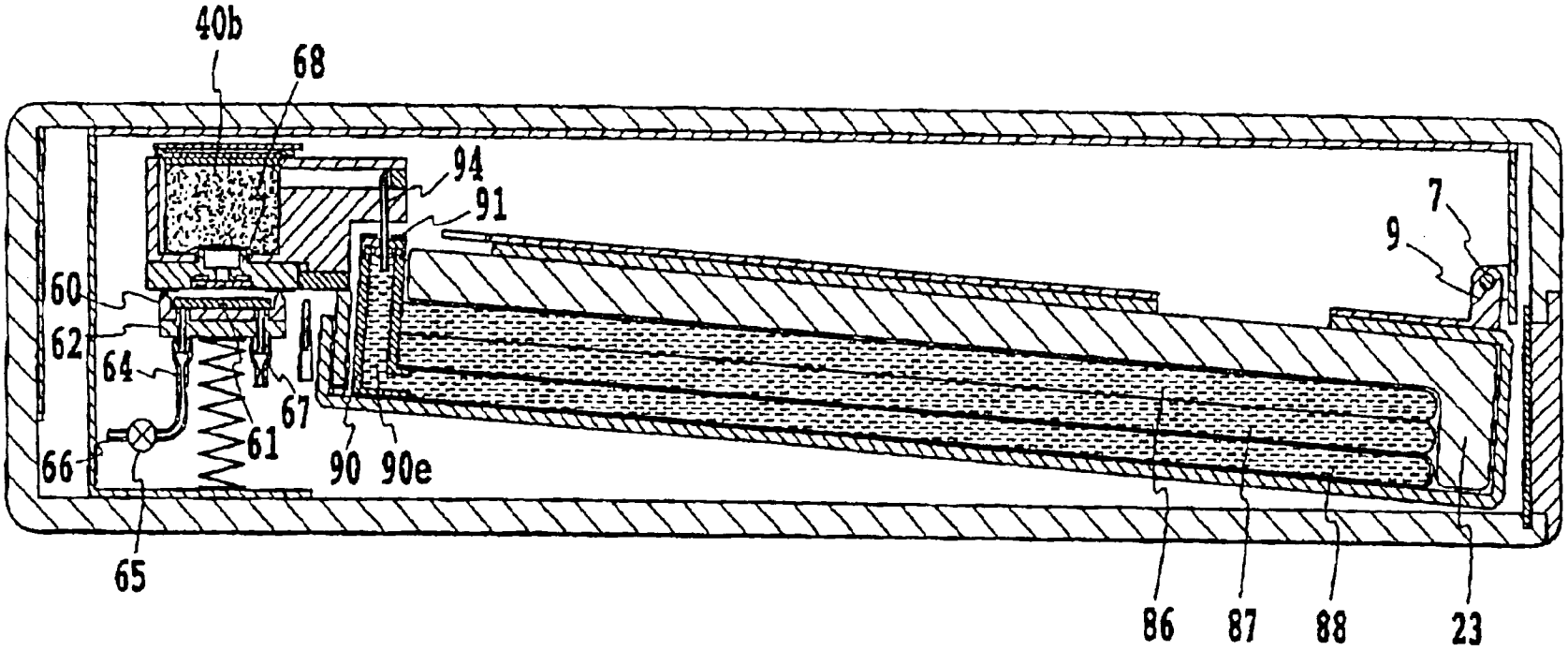
FIG. 13 is a sectional view of the printer in which the platen and the ink cartridge have been lifted up around a rotating shaft of the platen with respect to FIG. 11.

As required, in a state that the carriage is moved to a position as indicated in FIG. 12, the lead screw 57 is rotated as described above, and the lift slider 58 is slided inward, thereby having the lift pin 9*f* fixed on the platen 9 move along the lift cum 58*c* to cause the platen 9 to be rotated around a rotation shaft 7 of the platen as shown in FIG. 13, thereby lifting up the ink cartridge 12. In this condition, the ink supplying needle 94 is inserted into the joint rubber 91 and therefore allows the ink in the ink bag 88 to be intermittently supplied into the ink tank 40*b* of the carrier 40 through a room 90*e* of the joint case 90.

(Section Introducing Ink into Tank)

Reference numeral 48 denotes a suction joint made of silicon rubber or the like. As shown in FIG. 9, an L-shaped pipe 49 made of resin is inserted into the suction joint 48 via a part of a joint lever 51. The pipe 49 and the suction joint 48 are fixed to the joint lever 51. Further, since the joint lever 51 is urged utilizing the spring force of a torsion spring 52, a joint port 48*a* of the suction joint 48 is pressed against a suction port 40*a* when the carrier 40 lies at a predetermined position (the position in FIG. 3). However, no force is generated which removes the suction joint 48 from the pipe 49. Furthermore, a tube 50 made of silicon rubber or the like is inserted through the other end of the L-shaped pipe 49. The tube 50 is further connected to an air suction side of a cylinder pump 33. Then in the state shown in FIG. 9, when the cylinder pump 33 performs an air sucking operation, a negative pressure is exerted on the suction joint 48. Thus, air in the ink tanks 40*b*, 40*c*, and 40*d* is sucked from the suction port 40*a* through a gas-liquid separating membrane 55.

As shown in FIG. 9, a base portion of the joint lever 51 is rotatably supported on the hinge plate P9 by a rotating shaft 53, the hinge plate P9 being fixed to the printer main body P1. The torsion spring 52 is set on the rotating shaft 53. One arm of the rotating shaft 53 abuts against the printer main body P1, while the other arm abuts against the joint lever 51. Thus, the joint lever 51 is always urged clockwise in FIG. 9.

On the other hand, as shown in FIG. 9, the ink supply needles 94, 95, and 96 are pressed into the carrier 40 to form independent channels for the ink tanks 40*b*, 40*c*, and 40*d*. Positioning pins 97 and 98 have conical portions 97*a* and 98*a*, respectively, at their tips. The conical portions 97*a* and 98*a* are set below the tips of the ink supply needles. As the platen 9 and the ink cartridge 12 are lifted up, the conical portions 97*a* and 98*a* at the tips of the positioning pins 97 and 98, respectively, are positioned in the presser plate 89 before the ink supply needles 94, 95, and 96. This allows the ink supply needles 94, 95, ad 96 to be accurately inserted into the pieces of joint rubber 91, 92, and 93.

(Suction Mechanism)

Reference numeral 32 shown in FIG. 3 denotes a pump motor that drives a pump composed of the cylinder pump 33 and a piston 34. Well-known arrangements can be used for a reduction gear system disposed in a transmission path for the motor 32, mechanisms that drive the piston 34 and a piston shaft 34*a*, and the like. These arrangements are omitted to simplify the figures.

(Cap)

Figure 17:
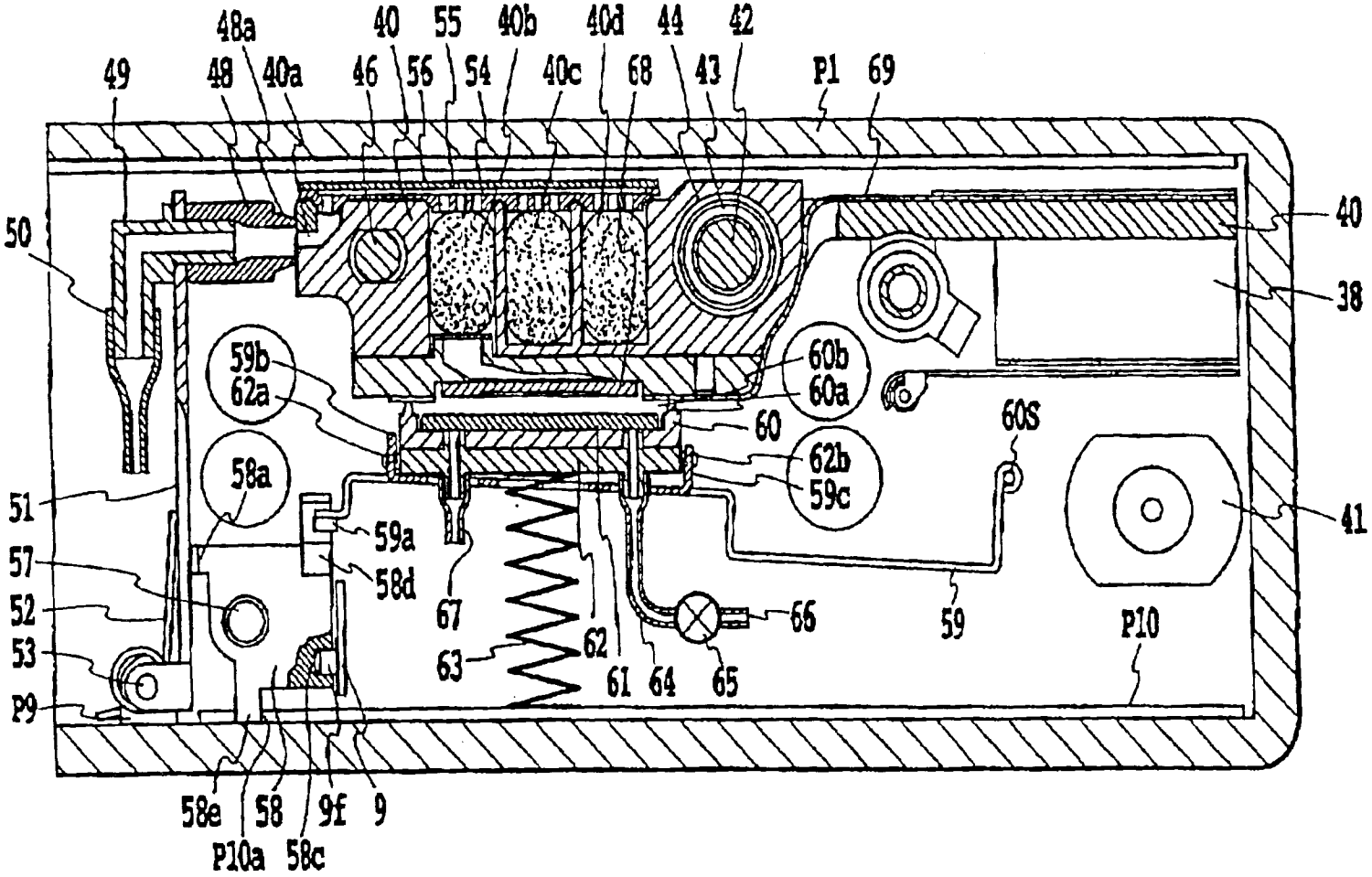
FIG. 17 is a view illustrating operations of a lift slider, a lock slider, and a suction joint according to the first embodiment.

The suction cap 60 is joined to an ejection opening formed surface of the printing head 68 in order to introduce ink as described above or to perform a suction recovery operation, described later, or other operations. The suction cap 60 is held by the cap holding plate 59. As shown in FIG. 4, the cap holding plate 59 can be rotated around a rotating shaft 60*s* supported by the printer main body P1. Fitting shafts 62*a* and 62*b* of the cap base 62 integrated with the suction cap 50 are engaged with caught portions 59*c* and 59*c* of the cap holding plate 59. At the position shown in FIG. 17 where the cap holding plate 59 is released from the cap cam 58*d*, a compression spring 63 always pushes up the cap base 62. Thus, the suction cap 60 is pressed against the carrier 40. In this case, the caught portions 59*b* and 59*c* of the cap holding plate 59 are fitted into slots formed in the cap 60 in its moving direction (in FIG. 4, a vertical direction), so as to equalize the suction cap 60 with the carrier 40. With such an equalizing property of the caught portions 59*b* and 59*c*, even if the cap holding plate 59 is not positioned very accurately, the suction cap 60 can close the printing head 68 as shown in FIG. 17.

The suction cap 60 is formed of, for example, chlorinated butyl rubber or the like. The suction cap 60 has a rib 60*a* provided on the entire periphery and which are pressed over the ink ejection opening formed surface of the printing head 68 held by the carrier 40 when a recovery operation or the like of the printing head 68 is performed. The rib 60*a* can be used to close the ink ejection opening formed surface. Further, a concave portion 60*b* is formed inside the rib 60*a*, with a relatively thin ink absorber 61 set in the concave portion 60*b*. Further, the suction cap 60 is formed with two holes through which pipe portions of the cap base 62 penetrate to contact with the ink absorber 61 as shown in FIG. 17.

A tube 67 connected to one of the pipe portions of the cap base 62 is connected to a suction side of the cylinder pump 33. When the pressure in the tube 67 becomes negative, the pressure in the closed space between the printing head 68 and the suction cap 60 becomes negative. Then, a suction force acts on the ink ejection port in the printing head 68 to enable the sucking of bubbles remaining in ink or ink of increased viscosity, or the like. Further, a tube 64 connected to the other pipe portion of the cap base 62 is connected to an atmospheric open valve 65 and then communicates with the atmosphere. Then, when a recovery process for the printing head 68 is completed, the atmospheric open valve 65 is opened to bring the closed space into communication with the atmosphere. Thus, the recovery operation is cleared quickly to suck ink absorbed by the ink absorber 61, via the tube 67. The ink is then guided out to the waste ink absorber 23 in the ink cartridge 12 through the drain pipe 20, described previously. These series of operations are commonly performed in ink jet printers. Accordingly, further description is omitted.

(Wiper Mechanism)

Figure 15:
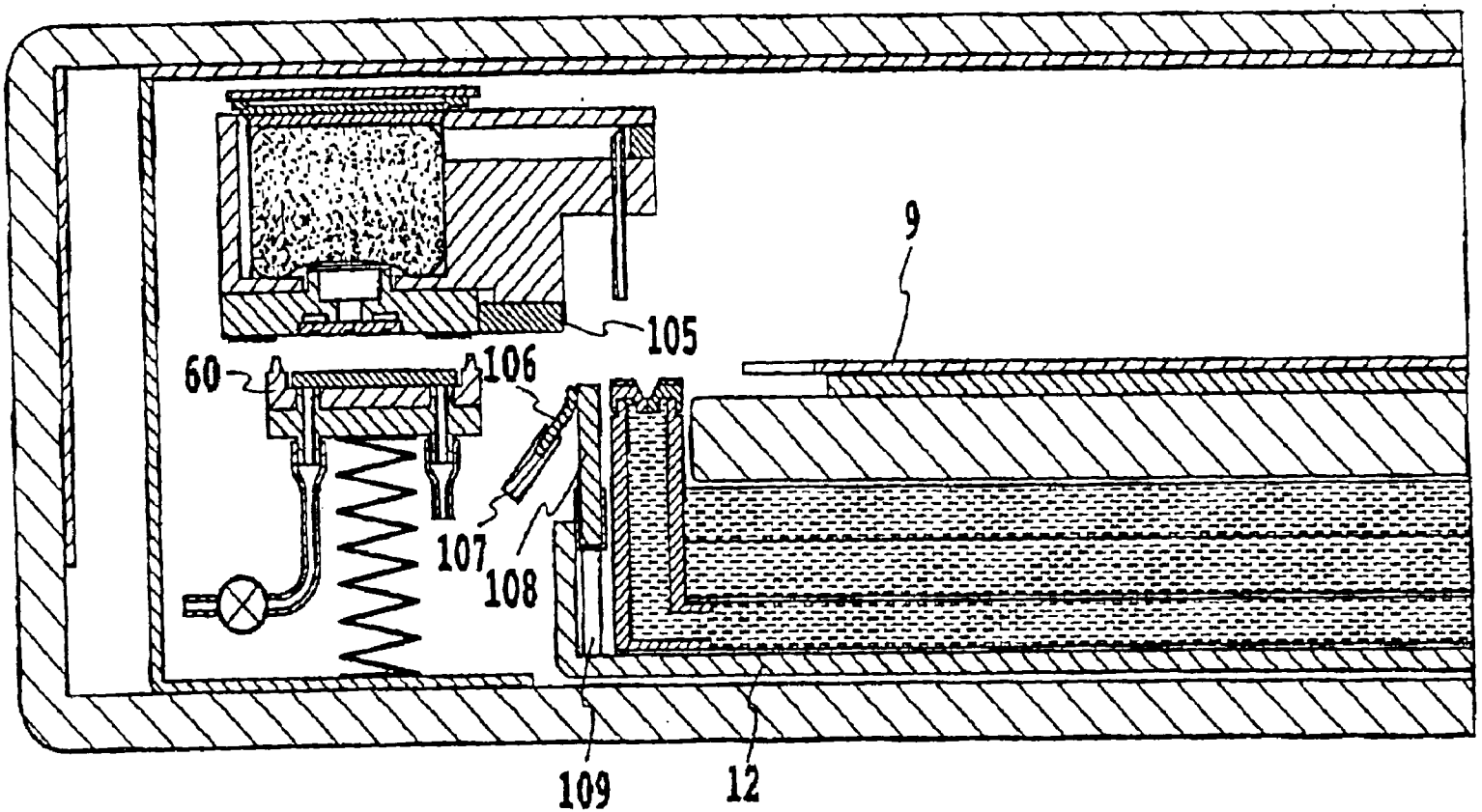

In FIG. 14, reference numeral 105 denotes an wiper ink absorber for temporarily absorbing waste ink adhered to a wiper blade 106 by which is wiped off the printing head 68. The wiper ink absorber is formed of a material such as a sponge. It is disposed on the carrier 40 so as to be substantially flush with surface of the printing head 68 on which the ejection openings are formed. The wiper blade 106 is formed of rubber or the like. It is attached to a wiper holder 107 so as to be movable in a vertical direction orthogonal to the scan direction of the carrier 40 (FIG. 11) and to be rotatable (FIG. 15). Specifically, when the wiper blade 106 is at its lifted position, it can engage with the ejection opening formed surface of the printing head to enable a wiping operation as shown in FIG. 14. When the wiper blade 106 is at its rotated position, it can engage with a wiper ink absorbing pad 108 as shown in FIG. 15 to transmit the waste ink adhering to the wiper blade 106, to the wiper ink absorbing pad 108 in the ink cartridge 12 (FIG. 15).

(Printing Operation)

The feeding roller 80 as shown in FIG. 2 is driven to convey a printing sheet P6 so as to set on a printing position. While the carrier 40 performs a reciprocate movement between the positions as shown in FIGS. 11 and 16, an amount of ink corresponding to an image date is ejected onto the print sheet P6 from the printing head 68 to perform a printing. At that time, by ejecting the ink to the outside of both ends P6*a*, P6*b* of the print sheet P6, full bleed printing is achieved. The ink ejected outside of the print sheet P6 is collected by the waste ink absorber 23 placed facing to the openings 12*c* provided with the ink cartridge 12.

(1.2) Description of Operations

Description will be given of operations performed until ink from the ink cartridge 12 is supplied to print a sheet.

FIG. 12 is a view showing a state observed immediately after an unused ink cartridge 12 has been completely installed through operations. The suction cap 60 is separated from the ejection opening formed surface of the printing head 68, mounted on the head holding plate 70 of the carrier 40, against the urging force of the spring 63. This position is the same as a printable position. The platen 9 and the ink cartridge 12 are at a first lift-up position. Specifically, the ink cartridge 12 has been installed at the position where it is not subjected to any lift-up operations.

The unused ink cartridge 12 is installed and the opening and closing lid 19 are completely closed. During this process, the lock slider 2 and the contact piece 3 are separated from each other and then contacted with each other again. Accordingly, a corresponding signal from the presence or absence sensing switch 28 is sensed to determine that the unused ink cartridge 12 has been completely installed. Then, when this signal is sensed, the motor 1 is driven to set a third lift-up position, show in FIG. 18. The third lift-up position also corresponds to a standby state in which a printing process has been finished but the next printing process has not been set yet. In order to prevent drying of ink remaining in sponges 72, 73, and 74 present in the ink tanks 40*b*, 40*c*, and 40*d*, respectively, the tips of the ink supply needles 94, 95, and 96 are moved closer to the pieces of joint rubber 91, 92, and 93, respectively. In order to minimize the drying, it is most effective to insert each ink supply needle into the joint rubber. However, if the joint rubber is made of elastomer or the like in order to reduce the force required to insert each ink supply needle into the joint rubber, then in the present embodiment, the ink supply needles are held in proximity to the joint rubber. This is because if the ink supply needles remain inserted into the joint rubber, the rubber is brought into a permanently distorted state in a short time to inconveniently cause ink leakage. It is exemplified that only a time frame for inserting the ink supply needle to the joint rubber in order to supply ink for printing would not cause a permanent deformation of the ink rubber. Further, at the third position, the wiper ink absorber 105 and the wiper ink absorbing pad 108 are always abutted against each other. This serves to minimize the amount of waste ink remaining in the wiper ink absorber 105.

Figure 18:
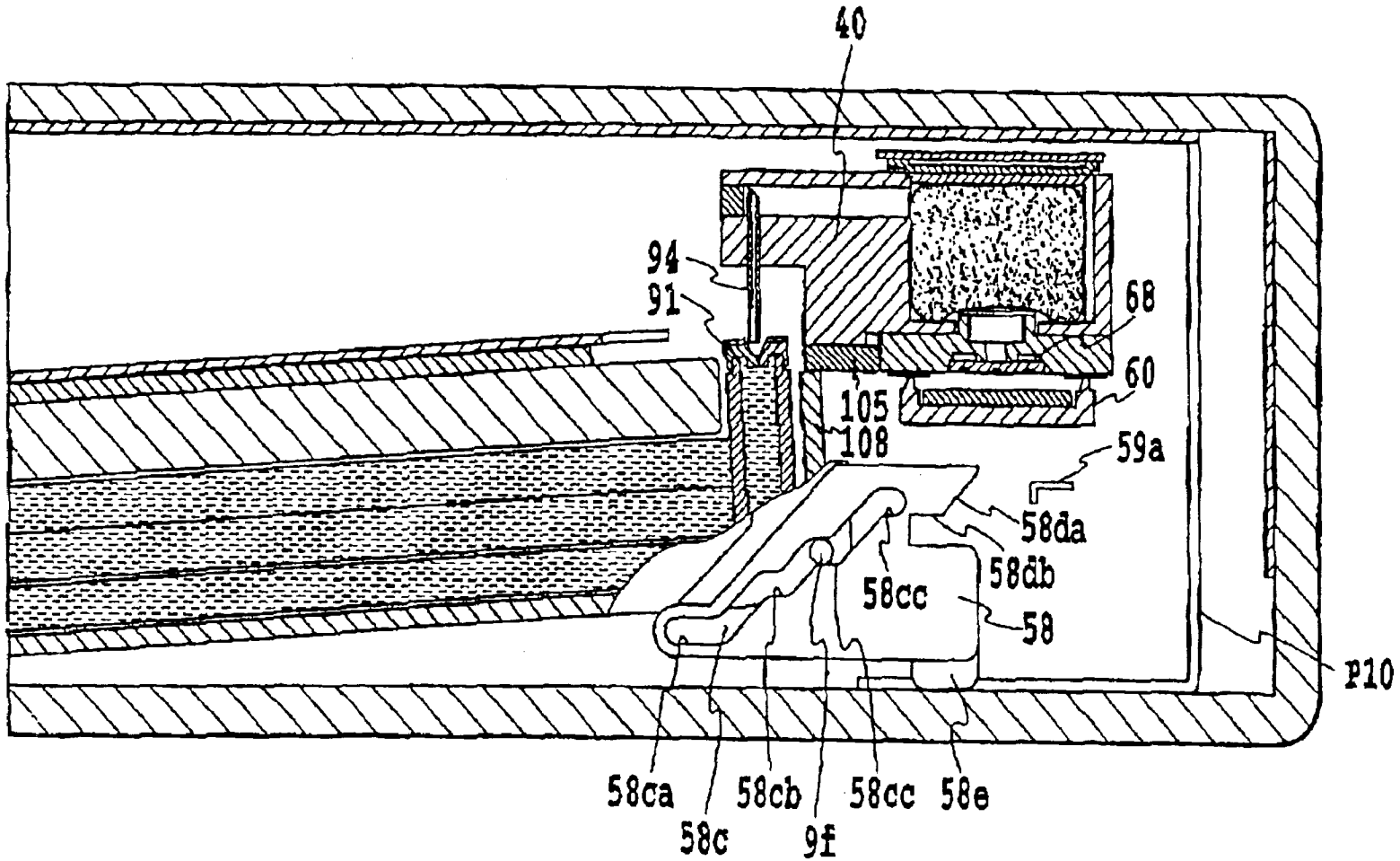
FIG. 18 is an enlarged sectional view showing a lift-up mechanism for the platen and the ink cartridge according to the first embodiment, to illustrate operations of the lift-up mechanism.
Figure 19:
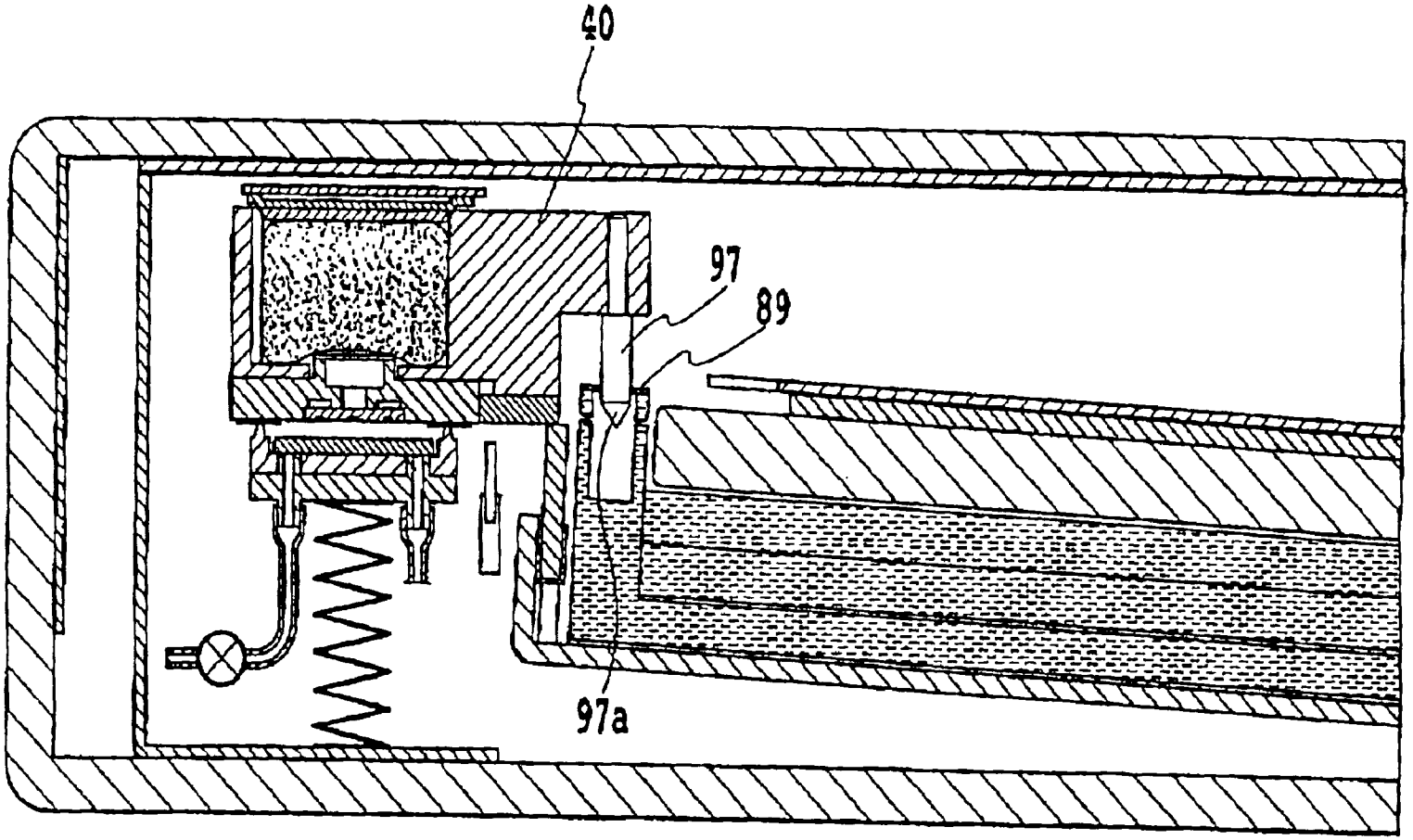
FIG. 19 is illustrating a condition that a positioning pin is on its way to be inserted to positioning hole of ink cartridge.

FIG. 19 is a view showing the conditions of the positioning pin 97 (this also applies to the positioning pin 98) at the third lift-up position shown in FIG. 18. The positioning hole in the presser plate 89 is not fitted over the conical tip of the positioning pin 97 (98) but over its straight portion. This prevents the carrier 40 from being moved and destroyed even if the printer is vibrated or inadvertently dropped.

Figure 20:
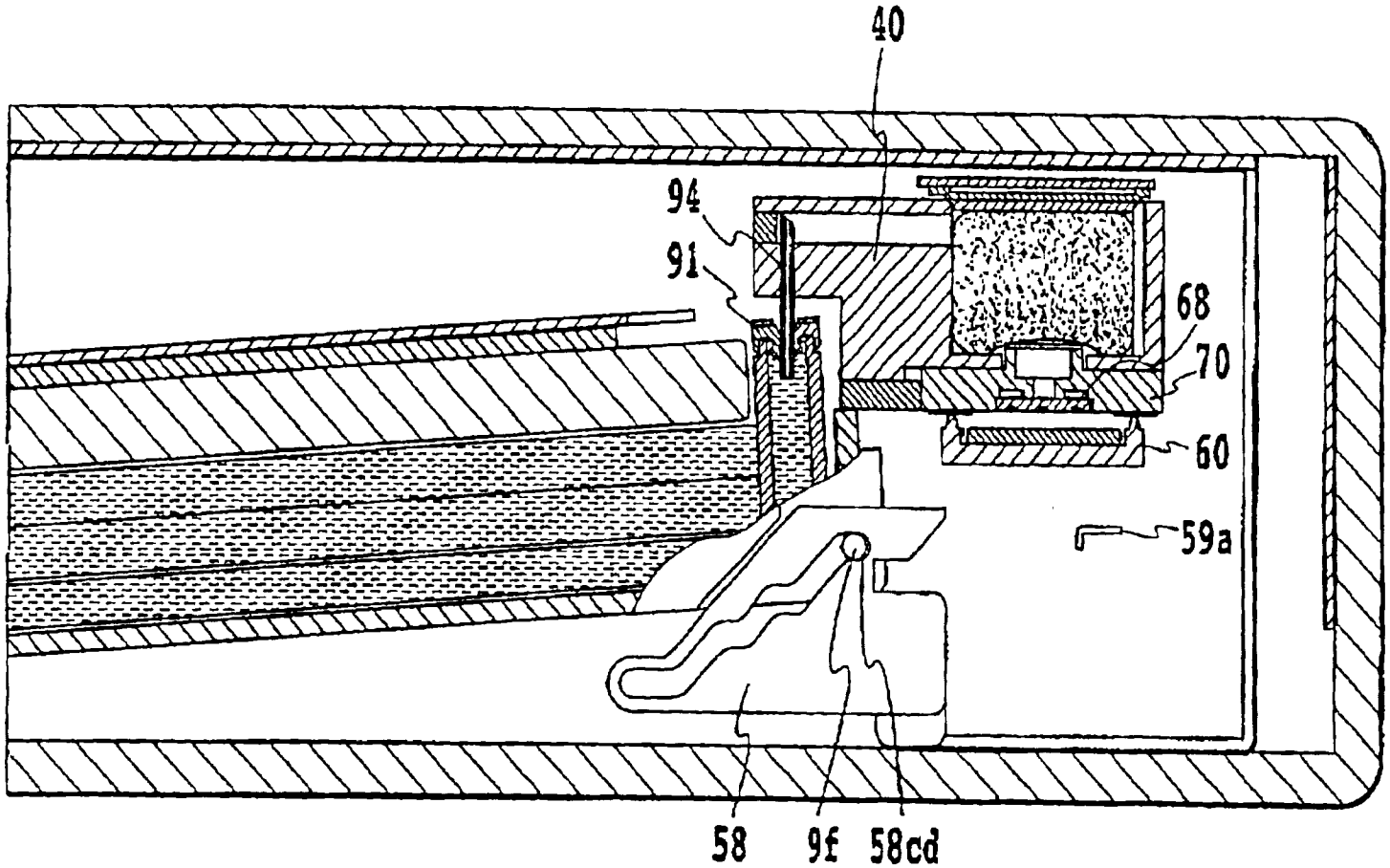
FIGS. 20 to 22 are enlarged sectional views showing the lift-up mechanism for the platen and the ink cartridge according to the first embodiment, to illustrate operations of the lift-up mechanism.

In the standby state shown in FIG. 18 or 19, when a print start switch, described later, is turned on, the operation described below is performed. The motor 1 is energized to set the platen 9 and the ink cartridge 12 at a fourth lift-up position as shown in FIG. 20. Ink from the ink bags 86, 87, and 88, used for printing, is supplied to the color ink tanks 40*b*, 40*c*, and 40*d*, respectively, on the carrier 40, via the ink supply needles 94, 95, and 96. This ink supplying operation is performed because the volume of each ink tank on the carrier 40 is very small (an amount corresponding to printing of a single sheet). At the fourth lift-up operation, the ink supplying operation is performed as shown in FIG. 17. Specifically, joint port 48*a* of the suction joint 48 abuts against the carrier 40 to start sucking air from inside the ink tanks 40*b*, 40*c*, and 40*d* through the suction port 40*a*. This negative pressure causes sucking of ink from the ink bags 86, 87, and 88 through the ink supply needles 94, 95, and 96, respectively. Further, each ink tank is provided with the membrane separating a gas and a liquid from each other, so that when the ink tank is filled with ink, the ink comes into contact with the gas-liquid separating membrane. Then, air cannot be sucked from the suction port 40*a*. Consequently, the ink supply is automatically stopped. Even in the state shown in FIG. 20, the suction cap 60 is pressed against and tightly contacted with the part of the carrier 40 in which the printing head 68 is located. This is because during ink supply, the pressure in each of the ink tanks 40*b*, 40*c*, and 40*d* becomes negative. That is, air is sucked from ink ejection openings to reduce the amount of ink supplied from the ink bags if the suction cap 60 is not tightly contacted with this part of the carrier 40. Further, at the fourth position, the platen 9 and the ink cartridge 12 are lifted up by the largest amount. The amount by which the spring for the pad holder 109 is compressed is set to be maximized in the state shown in FIG. 20 so as to properly abut the wiper ink absorber 105 and the wiper ink absorbing pad 108 against each other.

Once the operation shown in FIG. 20 fills ink in each of the ink tanks 40*b*, 40*c*, and 40*d*, the platen 9 and the ink cartridge 12 are set at the second lift-up position as an intermediate position between the third and first positions. At the second position, a recovery operation is performed in order to remove bubbles or the like remaining in the printing head 6. To perform a recovery operation, the spring 67 keeps the suction cap 60 closing the printing head 68 part, whereas the ink supply needles 94, 95, and 96 must be completely separated from the pieces of joint rubber 91, 92, and 93 in the present embodiment. The reason for this is described below. During a recovery operation, with the suction cap 60 closing the printing head 68 part, the cylinder pump 33 is activated to set the tube 67 at a negative pressure to suck ink from the printing head 68 and each ink tank, thus removing remaining bubbles or the like. If the ink supply needles are in contact with the joint rubber, they are closed to hinder the admittance of air, thus preventing remaining bubbles from being sucked from the printing head 68. This recovery operation can be preformed when the platen 9 and the ink cartridge 12 are at the first lift-up position instead of the second lift-up position. However, if this recovery operation is performed at the first position, then when the lift-up mechanism described later performs an operation, the lift cam is markedly inclined to increase driving loads on the motor 1 to severely consume batteries. Therefore, the recovery operation is preferably performed at the second position.

The recovery operation is commonly performed in ink jet printers. Thus, further description is omitted.

Once the recovery operation is completed, for preparations for a wiper operation, the suction cap 60 is separated from the carrier 40 against the urging force of the spring 67 to set the platen 9 and the ink cartridge 12 at the first position as in the case with a printing operation.

In this, the carrier 40 is moved beyond the wiper 106 to the position shown in FIG. 11. Then, the wiper blade 106 is moved toward the carrier 40 from the lowered position shown in FIG. 12 to the lifted position shown in FIG. 11. Then, the carrier 40 is moved leftward at a predetermined speed to abut a corner of the wiper blade against the printing head 68, with the wiper blade 106 flexed, as shown in FIG. 14. It is thus possible to wipe off unwanted ink adhering to the ejection opening formed surface of the printing head 68. Furthermore, the suction cap 60 is moved further leftward in this figure so that the wiper blade 106 abuts against the wiper ink absorber 105.

In this state, the carrier 40 is stopped. Then, as shown in FIG. 15, the wiper blade 106 is rotated clockwise together with the wiper holder 107 to press the wiper blade 106 against the wiper ink absorbing pad 108. This serves to wipe off waste ink remaining on the wiper blade 106.

Next, the wiper blade 106 and the wiper holder 107 are set at the initial standby position. In the state shown in FIG. 12, the previously described sheet feeding roller 80 is driven to convey the print sheet 79 and to set it at a print position. Then, while the carrier 40 is reciprocated between positions shown in FIGS. 11 and 16, ink is ejected from the printing head 68 for printing, corresponding to image data.

(1.3) Operations of Lift-Up Mechanism

Description will be given of operations of the lift-up mechanism for the platen 9 and the ink cartridge 12.

Figure 21:
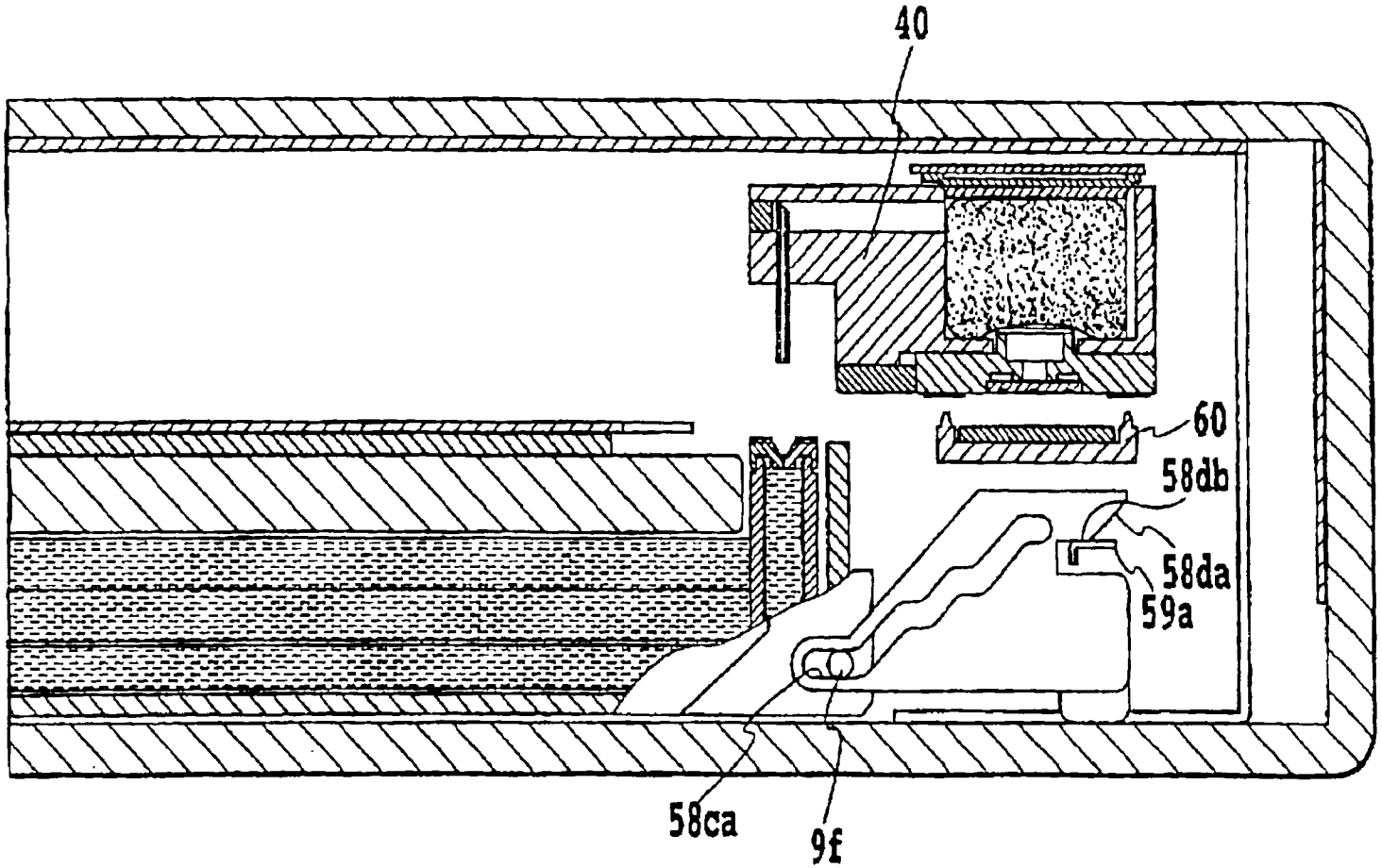

In the state shown in FIGS. 4 and 21, the cam of the lift slider 58 is at the first position (FIG. 21). The lift pin 9*f*, fixed to the platen 9, is fitted into the lift cam 58*c* as the cam groove in the lift slider 58, to hold the platen 9 and the cartridge 12 at substantial horizontal positions. Of course, the cap cam 58*d* pushes down the engaging portion 59*a* of the cap holding plate 59 of the suction cap 60. Accordingly, the suction cap 60 is separated from the part of the carrier 40 in which the printing head 68 is located.

At this position, the lift pin 9*f* of the platen 9 is located at a first position 58*ca* of the lift cam 58*c*. As shown in FIGS. 4 and 21, the engaging portion 59*a* of the cap holding plate 59 is located at a pressing surface position 58*db* of the cap cam 58*d*. The cap 60 is separated from the printing head 68 part of the carrier 40.

In the state in which the motor 1 is driven to rotate the lead screw 57 to move the lift slider 58 slightly leftward, the lift pin 9*f* maintains the first position 58*ca*. The engaging portion 59*a* of the cap holding plate 59 moves within the pressing surface position 58*db* of the cap cam 58*d* but is not separated from the cam surface 58*db*. The suction cap 60 keeps away from the carrier 40.

In this state, the lift cam 58*c* is still at the first position. The platen 9 and the ink cartridge 12 maintain their horizontal state. The cap cam 58*d* pushes down the engaging portion 59*a* of the cap holding plate 59 together with the suction cap 60. Therefore, a printing operation can be performed.

Figure 22:
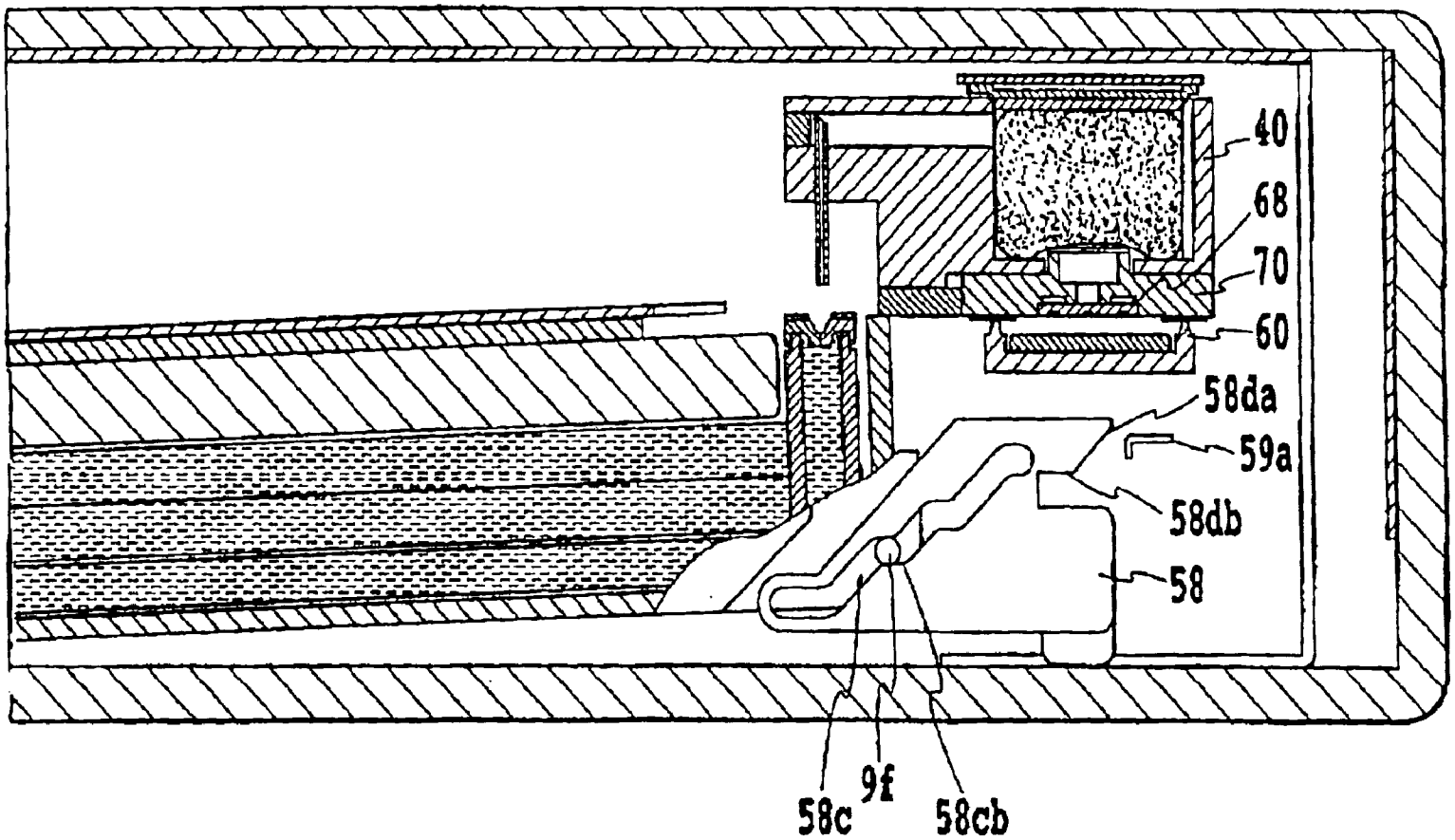

In the state shown in FIG. 22, the lift slider 58 is moved further leftward to cause the lift cam 58*c* to push up the lift pin 9*f* of the plate 9, thereby the lift pin 9*f* is located on a cam face 58*cb*. Thus, the platen 9 and the ink cartridge 12 are rotated around the rotating shafts 7 and 10 of the platen 9 and placed at the second position.

The platen 9 and the ink cartridge 12 are lifted up to their second positions and are thus slightly inclined. However, they are still separate from the ink supply needles 94, 95, and 96. Further, the engaging portion 59*a* of the cap holding plate 59 is moved from the pressing surface position 58*db* of the cap cam 58*d* to a free position via a slope 58*da*. While being equalized with the head holding plate 70 on the carrier 40, the suction cap 60 closes the ejection opening formed surface of the printing head 68 owing to the urging force of the spring 63. Therefore, a recovery operation can then be performed.

In the state shown in FIG. 18, in order to establish the standby position, at which ink can be stored for a long time, the lead screw 57 is further rotated to move the lift slider 58 leftward to place the lift pin 9*f* at a third position 58*cc* of the lift cam 58*c*. Thus, the platen 9 and the ink cartridge 12 are set at the third position. In this state, the tips of the ink supply needles 94, 95, and 96 are closest to the pieces of joint rubber 91, 92, and 93, respectively. Of course, the engaging portion 59*a* of the cap holding plate 59, which controls the position of the suction cap 60, is further separated from the cap cam 58*d*. Accordingly, the ejection opening formed surface of the printing head 68 is kept closed by the suction cap 60.

In the state shown in FIG. 20, the lift slider 58 is moved to its leftmost position. The lift pin 9*f* is placed at the highest fourth position 58*cd*.

In this state, the ink supply needles 94, 95, and 96 are inserted into the pieces of joint rubber 94, 95, and 96 so that ink can be supplied to the interior of each ink tank on the carrier 40. Even at this position, the suction cap 60 keeps closing the printing head 68.

(2) Second Embodiment

Figure 23:
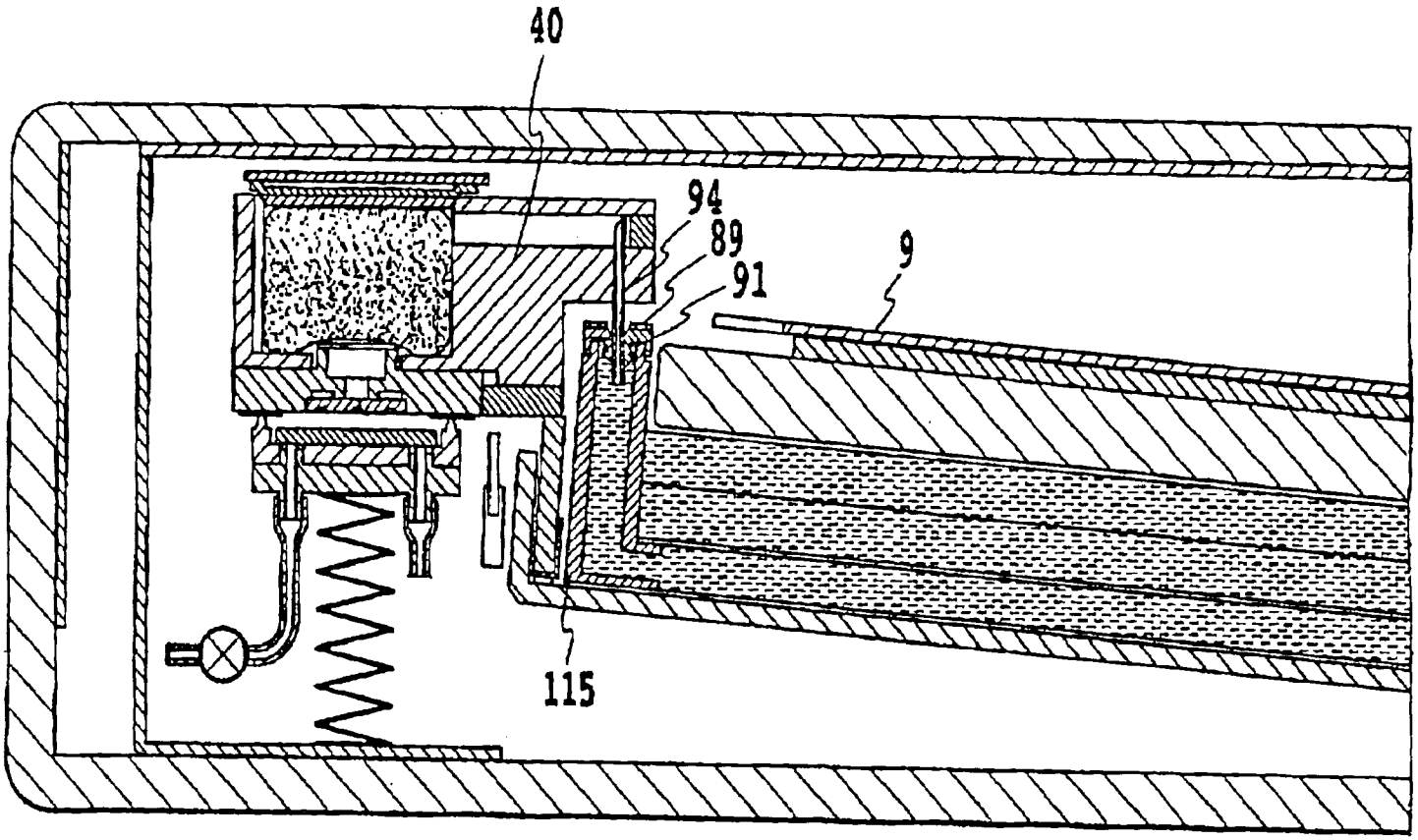
FIG. 23 is an enlarged sectional view taken along the carrier scanning direction and showing a part of the print mechanism to illustrate a second embodiment of the present invention.

FIG. 23 is a view illustrating an embodiment that optimizes lift-up operations.

In the configuration shown in FIG. 23, a joint case 115 is provided in place of the joint case 90 in the first embodiment. The joint case 115 has a surface on which the pieces of joint rubber 91, 92, and 93 are mounted and which is inclined by an angle (for instance, 4 degrees) equal to the maximum amount of rotation of the platen 9 (in this case, the platen 9 is rotated clockwise through 4 degrees) in a direction (counterclockwise in the figure) opposite to the direction in which it is rotated when the platen 9 is lifted up. FIG. 23 shows that the ink supply needles 94, 95, and 96 are stuck into the pieces of joint rubber 91, 92, and 93, respectively. In the first embodiment, in which the above surface is not inclined, the ink supply needles are obliquely stuck into the joint rubber. In contrast, in the present embodiment, the ink supply needles are stuck into the joint rubber in the vertical direction. This sharply increases the number of times that the joint rubber can endure the sticking of the ink supply needle.

Incidentally, in fitting conditions of the positioning pins 97 and 98 into the joint case 115, the inclination of the positioning pins from the presser plate 89 is reduced. Therefore, positioning accuracy is improved.

(3) Third Embodiment

Figure 24:
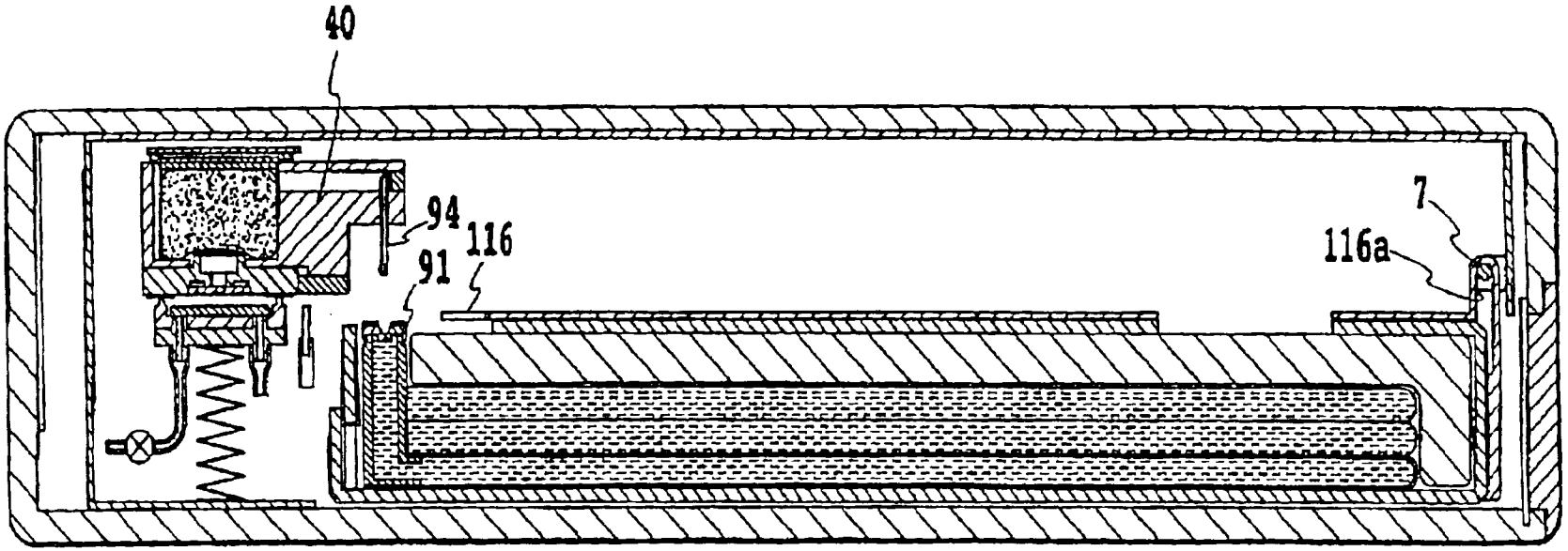
FIG. 24 is a sectional view of the print mechanism taken along the carrier scanning direction to illustrate a configuration and operations of a third embodiment of the present invention.
Figure 25:
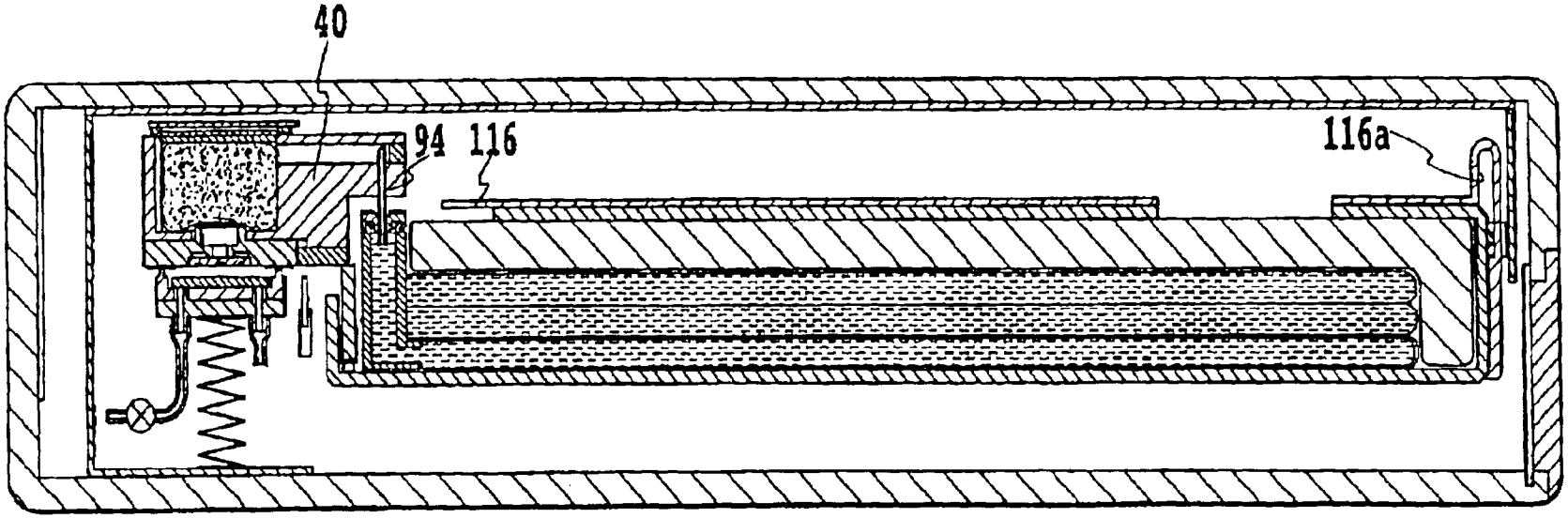
FIG. 25 is a sectional view of the print mechanism taken along the carrier scanning direction to illustrate the configuration and operations of the third embodiment of the present invention.

FIGS. 24 and 25 show an embodiment in which lift-up operations comprise vertical parallel driving instead of rotations.

Specifically, instead of rotating the platen around the rotating shaft to lift it up as with the first embodiment, a slot 116*a* in a platen 116 is fitted over the positioning pin 7 (the pin 7 is paired with pin 10, as shown in FIG. 3) to allow the platen 116 to be lifted up perpendicularly to the horizon including the scanning direction of the carrier 40 as shown in FIG. 25. This prevents the ink supply needle 94 and others from being obliquely stuck into the piece of joint rubber 91 and others, respectively. It is thus possible to produce effects similar to those in the second embodiment. Further, the ink supply needle 94 and others advance into the piece of joint rubber 91 and others, respectively, without any inclination. Therefore, ink can be supplied more reliably.

(4) Others

In the above embodiments, the ink cartridge 12 is slidably installed on the platen 9 in the same direction as that in which the printing head is scanned during printing. However, the installing direction is not limited to this aspect. For example, the ink cartridge 12 may be installed from a direction perpendicular to the scanning direction of the printing head 68, i.e. from the bottom surface of the printer or the like. It should be appreciated that this configuration also produces effects similar to those described above.

The present invention employs the entirely new concept that ink is intermittently supplied properly by moving the ink supply side to the joint position without moving the printing head, while employing the intermittent supply method and effectively utilizing spaces to reduce the size of an ink jet printer. The present invention thus provides an ink jet printer that does not affect the mounting accuracy of the printing head, i.e. an ink jet printer that can maintain a high printing grade for a long time.

The above described embodiments can also produce the effects described below.

The housing portion that houses ink to be supplied to the printing head is arranged on that side of the printing head of the ink jet printer which is opposite its side scanned over a print position on a print sheet. The housing portion is moved to or from the scanning space of the printing head so as to be joined to the printing head as required for an ink supply. This eliminates the need for a complicated mechanism otherwise required to supply ink to the printing head. This further eliminates the need for a special movement operation of the printing head itself (i.e., a movement operation in a moving direction different from the main scanning direction) for the sake of an ink supply operation which differs from the reciprocate scanning path for printing operation. As a result, a deterioration of the positioning accuracy of the printing head will be restricted and a need for a strict accuracy administration will also be eased. Further, the supplied ink housing portion is laid out in the space below the platen, which is otherwise ineffectively used. This makes it possible to improve significantly the spatial efficiency of the printer. Therefore, the size of the printer can be sharply reduced.

In this case, the rotating shaft is provided on the member (for example, the platen) that sets the print sheet at the print position. Then, the ink housing portion is coupled to this member so as to be rotatable and thus movable to and from the scanning space of the printing head. This enables accurate positioning during a ink supply to provide a stable joint mechanism for supplying ink.

Further, the ink housing portion is in the form of an ink cartridge that can be installed in and removed from the printer through the rotating shaft side of the member such as the platen. It is thus possible reduce the size of the installation port, through which the ink cartridge is installed or removed, thus increasing the strength of the body. Further, the lift mechanism for rotations around the rotating shaft can be disposed away from the installation port. This prevents the attachment of dust or the like.

Further, by installing the ink cartridge at the position defined by the present invention, a part of the ink cartridge is located within a moving path of a wiper provided at an end of a head scanning range (a home position). It allows to provide an absorber (wiper ink absorbing pad) in the ink cartridge to absorb waste ink resulting from an operation performed by the wiper to wipe off ink or the like remaining on the ejection opening formed surface of the printing head, and to transfer the waste ink to the ink cartridge for each printing operation. A place where the ink cartridge as such replaceable member is placed conforming to a place where the wiper ink absorbing pad is place, whereby the wiper ink absorbing pad will be replaced with new one at the same time of ink cartridge replacement. This replacement enables refreshment of an absorbing ability of the wiper ink absorbing pad before the ability is deteriorated.

By constructing the ink cartridge so as to be placed at a position as described in the present invention, in order for enabling a full bleed print for a printing medium, a waste ink absorber for collecting ink ejected to the outside of the width of the printing medium can be provided with the cartridge 12. The waste ink absorber will be replaced at the same time of replacing the ink cartridge, and thus the waste ink absorber will be replaced and refreshed before its absorbing ability is reduced.

This eliminates the need to provide the printer with a space in which the waste ink is stored. It is thus possible to miniaturize the printer and eliminate the need to consider the flow of the waste ink.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printer for performing printing on a printing medium by using a printing head for ejecting ink, comprising:

holding means for holding a housing portion that houses ink to be supplied to said printing head, the holding means being located, acrossing an area where a printing is performed onto the printing medium by said printing head, in a space opposite to a space in which said printing head performs a scanning onto the printing; and moving means for moving said housing portion to and from a scanning space in which said printing head is subjected to said scanning, and once said housing portion has moved to the scanning space, joining said printing head and said housing portion together to allow ink to be supplied.

2. An ink jet printer as claimed in claim 1, wherein said holding means is provided in a member that sets said printing medium at a print position where said printing head performs a print operation, and said moving means has a shaft for rotatably supporting said member and means for rotating said member around said shaft to move said housing portion to and from said scanning space.

3. An ink jet printer as claimed in claim 2, wherein said holding means being in the form of a cartridge is allowed to install and remove through said rotating shaft side.

4. An ink jet printer as claimed in claim 1, wherein said holding means is provided in a member that sets said printing medium at a print position where said printing head performs a print operation, and said moving means move said housing portion to and from said scanning space, by moving said member in a direction substantially perpendicular to the scanning direction of said printing head.

* * * * *